US009791190B2

(12) United States Patent
Hanafusa

(10) Patent No.: US 9,791,190 B2
(45) Date of Patent: Oct. 17, 2017

(54) CONDENSER

(71) Applicant: KEIHIN THERMAL TECHNOLOGY CORPORATION, Oyama-shi (JP)

(72) Inventor: Tatsuya Hanafusa, Oyama (JP)

(73) Assignee: KEIHIN THERMAL TECHNOLOGY CORPORATION, Oyama-Shi (JP)

( * ) Notice: Subject to any disclaimer, the term of this patent is extended or adjusted under 35 U.S.C. 154(b) by 282 days.

(21) Appl. No.: 14/709,484

(22) Filed: May 12, 2015

(65) Prior Publication Data

US 2015/0241097 A1 Aug. 27, 2015

Related U.S. Application Data

(63) Continuation of application No. 12/929,620, filed on Feb. 4, 2011, now Pat. No. 9,062,919.

(30) Foreign Application Priority Data

Feb. 16, 2010 (JP) ..... 2010-030867
Jan. 11, 2011 (JP) ..... 2011-003231

(51) Int. Cl.
*F28D 7/16* (2006.01)
*F28D 21/00* (2006.01)
(Continued)

(52) U.S. Cl.
CPC ..... *F25B 39/04* (2013.01); *F28D 1/05375* (2013.01); *F28F 9/02* (2013.01);
(Continued)

(58) Field of Classification Search
CPC . F28F 9/0202; F28F 9/0263; F25B 2339/044; F25B 2339/0441;
(Continued)

(56) References Cited

U.S. PATENT DOCUMENTS 4,936,379 A * 6/1990 Hoshino ..... B21C 37/22 165/110
4,962,811 A 10/1990 Yamamoto
(Continued)

FOREIGN PATENT DOCUMENTS

| | | |
|---|---|---|
| JP | 3-31266 U | 3/1991 |
| JP | 11-316065 | 11/1999 |
| JP | 2005-321151 | 11/2005 |
| JP | 2007-085573 | 4/2007 |

OTHER PUBLICATIONS

Japanese Office Action for corresponding JP Application No. 2011-003231, dated Aug. 19, 2014.

*Primary Examiner* — Frantz Jules
*Assistant Examiner* — Erik Mendoza-Wilkenfel
(74) *Attorney, Agent, or Firm* — Mori & Ward, LLP

(57) ABSTRACT

A condenser includes first and second header tanks provided on one side of the condenser, and a third header tank provided on another side of the condenser. A plurality of second heat exchange tubes extend in an extending direction between the second header tank and the third header tank to connect the second header tank and the third header tank. A plurality of first heat exchange tubes are provided to extend in the extending direction between the first header tank and the third header tank to connect the first header tank and the third header tank. The plurality of first heat exchange tubes are directly connected to the first header tank. The plurality of first heat exchange tubes are longer than the plurality of second heat exchange tubes and are positioned downstream of the plurality of second heat exchange tubes with respect to a flow of refrigerant.

15 Claims, 9 Drawing Sheets

(51) Int. Cl.

| | |
|---|---|
| ***F28D 9/02*** | (2006.01) |
| ***F25B 39/04*** | (2006.01) |
| ***F28D 1/053*** | (2006.01) |
| ***F28F 9/02*** | (2006.01) |
| *F25B 40/02* | (2006.01) |

(52) U.S. Cl.
CPC ..... *F28F 9/0209* (2013.01); *F25B 40/02* (2013.01); *F25B 2339/044* (2013.01); *F28D 2021/0084* (2013.01)

(58) Field of Classification Search
CPC ..... F28D 2021/0063; F28D 2021/0007; F28D 2021/0084
See application file for complete search history.

(56) References Cited

U.S. PATENT DOCUMENTS

| | | | | |
|---|---|---|---|---|
| 5,203,407 | A | 4/1993 | Nagasaka | |
| 5,546,761 | A | 8/1996 | Matsuo et al. | |
| 5,946,940 | A | 9/1999 | Inoue | |
| 8,307,669 | B2 | 11/2012 | Taras et al. | |
| 2003/0213583 | A1* | 11/2003 | Kamishima ..... | F25B 39/04 165/82 |
| 2005/0247439 | A1 | 11/2005 | Wada et al. | |
| 2007/0131393 | A1 | 6/2007 | Sasaki | |
| 2008/0296005 | A1 | 12/2008 | Taras et al. | |
| 2011/0186277 | A1 | 8/2011 | Hanafusa | |
| 2011/0253353 | A1 | 10/2011 | Tokizaki et al. | |

* cited by examiner

CONDENSER

CROSS-REFERENCE TO RELATED APPLICATIONS

The present application is a continuation application of the U.S. patent application Ser. No. 12/929,620 filed Feb. 4, 2011, which claims priority to Japanese Patent Application No. 2010-030867, filed on Feb. 16, 2010, and Japanese Patent Application No. 2011-003231, filed on Jan. 11, 2011. The contents of these applications are incorporated herein by reference in their entirety.

BACKGROUND OF THE INVENTION

The present invention relates to a condenser.

In the embodiments, the term "condenser" encompasses not only ordinary condensers but also sub-cool condensers each including a condensation section and a super-cooling section.

Further, in the embodiments, the upper side, lower side, left-hand side, and right-hand side of FIGS. 1 and 3 will be referred to as "upper," "lower," "left," and "right," respectively.

A condenser for a car air conditioner is known (see Japanese Utility Model Application Laid-Open (kokai) No. H3-31266). The known condenser includes a plurality of heat exchange tubes disposed in parallel such that they are spaced apart from one another in a vertical direction; and header tanks which extend in the vertical direction and to which left and right end portions of the heat exchange tubes are connected, respectively. Three heat exchange paths each formed by a plurality of heat exchange tubes successively arranged in the vertical direction are provided such that the three heat exchange paths are juxtaposed in the vertical direction. Refrigerant flows in the same direction through all the heat exchange tubes which form each heat exchange path, and the flow direction of refrigerant flowing through the heat exchange tubes which form one of two adjacent heat exchange paths is opposite the flow direction of refrigerant flowing through the heat exchange tubes which form the other heat exchange path. A first header tank and a second header tank are individually provided at the left end or right end. The heat exchange tubes which form the heat exchange path at the lower end are connected to the first header tank. The heat exchange tubes which form the heat exchange paths other than the lower end heat exchange path are connected to the second header tank. The second header tank is disposed above the first header tank. The thickness (diameter) of the first header tank is rendered considerably larger than that of the second header tank, and a desiccant is disposed within the first header tank. Thus, the first header tank functions as a liquid receiver which separates gas and liquid from each other and stores the separated liquid. The first heat exchange tubes connected to the first header tank are equal in length to the second heat exchange tubes connected to the second header tank, and the ends of the first heat exchange tubes on the side toward the first header tank and the ends of the second heat exchange tubes on the side toward the second header tank are located on the same vertical line. All the heat exchange paths serve as refrigerant condensation paths for condensing refrigerant.

In the condenser disclosed in the publication, the internal volume of the first header tank must be rendered considerably large as compared with that of the second header tank, in order to effectively perform gas liquid separation within the first header tank. Therefore, the thickness of the first header tank is considerably large as compared with the second header tank, which raises a problem in that a large space is required for installing the condenser.

In general, other devices are disposed in the vicinity of a condenser. In the case of the condenser disclosed in the publication, the first header tank hinders installation of other devices. For example, a radiator is typically disposed downstream (with respect to an air passage direction) of a condenser for a car air conditioner. If the condenser disclosed in the publication is used, the first header tank hinders installation of the radiator. As a result, a wasteful space is produced within an engine compartment, which makes space saving difficult. In addition, since the heat exchange tubes are connected over substantially the entire length of the first header tank, the conventional condenser has a problem in that its gas liquid separation performance is not satisfactory.

SUMMARY OF THE INVENTION

According to one aspect of the present invention, a condenser includes heat exchange tubes disposed in parallel such that the heat exchange tubes are spaced apart from one another in a vertical direction and extend in a left-right direction. Header tanks extend in the vertical direction. Left and right end portions of the heat exchange tubes are connected to the header tanks. First and second header tanks are provided at the left or right end of the condenser. The first header tank is disposed on an outer side of the second header tank with respect to the left-right direction, has an upper end located above a lower end of the second header tank, and has a function of separating gas and liquid from each other and storing the liquid. First heat exchange tubes connected to the first header tank have projecting portions at their ends located on a side toward the first header tank. The projecting portions extend outward, with respect to the left-right direction, of second-header-tank-side end portions of second heat exchange tubes connected to the second header tank. The first heat exchange tubes are longer than the second heat exchange tubes by a length of the projecting portions in the left-right direction and are positioned downstream of the second heat exchange tubes with respect to a flow of refrigerant. Fins are disposed between the projecting portions of adjacent first heat exchange tubes. The projecting portions of all the first heat exchange tubes and the fins between the projecting portions of the adjacent first heat exchange tubes form a heat exchange section.

According to another aspect of the present invention, a condenser includes a second header tank which is provided on one side of the condenser with respect to a left-right direction of the condenser to extend in a first direction perpendicular to the left-right direction. A first header tank is provided on the one side of the condenser to extend in the first direction and at an outer side of the second header tank with respect to the left-right direction and has a gas-liquid separation function. An upper end of the first header tank is located above a lower end of the second header tank. A third header tank is provided on another side of the condenser opposite to the one side with respect to the left-right direction. A plurality of second heat exchange tubes extend in the left-right direction between the second header tank and the third header tank to connect the second header tank and the third header tank. A plurality of first heat exchange tubes are provided to extend in the left-right direction between the first header tank and the third header tank to connect the first header tank and the third header tank. The plurality of first heat exchange tubes are directly connected to the first header tank. The plurality of first heat exchange tubes are longer than the plurality of second heat exchange tubes by a length of projecting portions in the left-right direction and are positioned downstream of the plurality of second heat exchange tubes with respect to a flow of refrigerant. Fins are provided between the plurality of first heat exchange tubes at the projecting portions.

According to further aspect of the present invention, a condenser includes a second header tank which is provided on one side of the condenser, a first header tank provided on the one side of the condenser and having a gas-liquid separation function. An upper end of the first header tank is located above a lower end of the second header tank. A third header tank is provided on another side of the condenser opposite to the one side. A plurality of second heat exchange tubes extend in an extending direction between the second header tank and the third header tank to connect the second header tank and the third header tank. A plurality of first heat exchange tubes are provided to extend in the extending direction between the first header tank and the third header tank to connect the first header tank and the third header tank. The plurality of first heat exchange tubes are directly connected to the first header tank. The plurality of first heat exchange tubes are longer than the plurality of second heat exchange tubes by a length of projecting portions in the extending direction and are positioned downstream of the plurality of second heat exchange tubes with respect to a flow of refrigerant. Fins are provided between the plurality of first heat exchange tubes at the projecting portions.

DESCRIPTION OF THE PREFERRED EMBODIMENT

Embodiments of the present invention will next be described with reference to the drawings.

Figure 1:
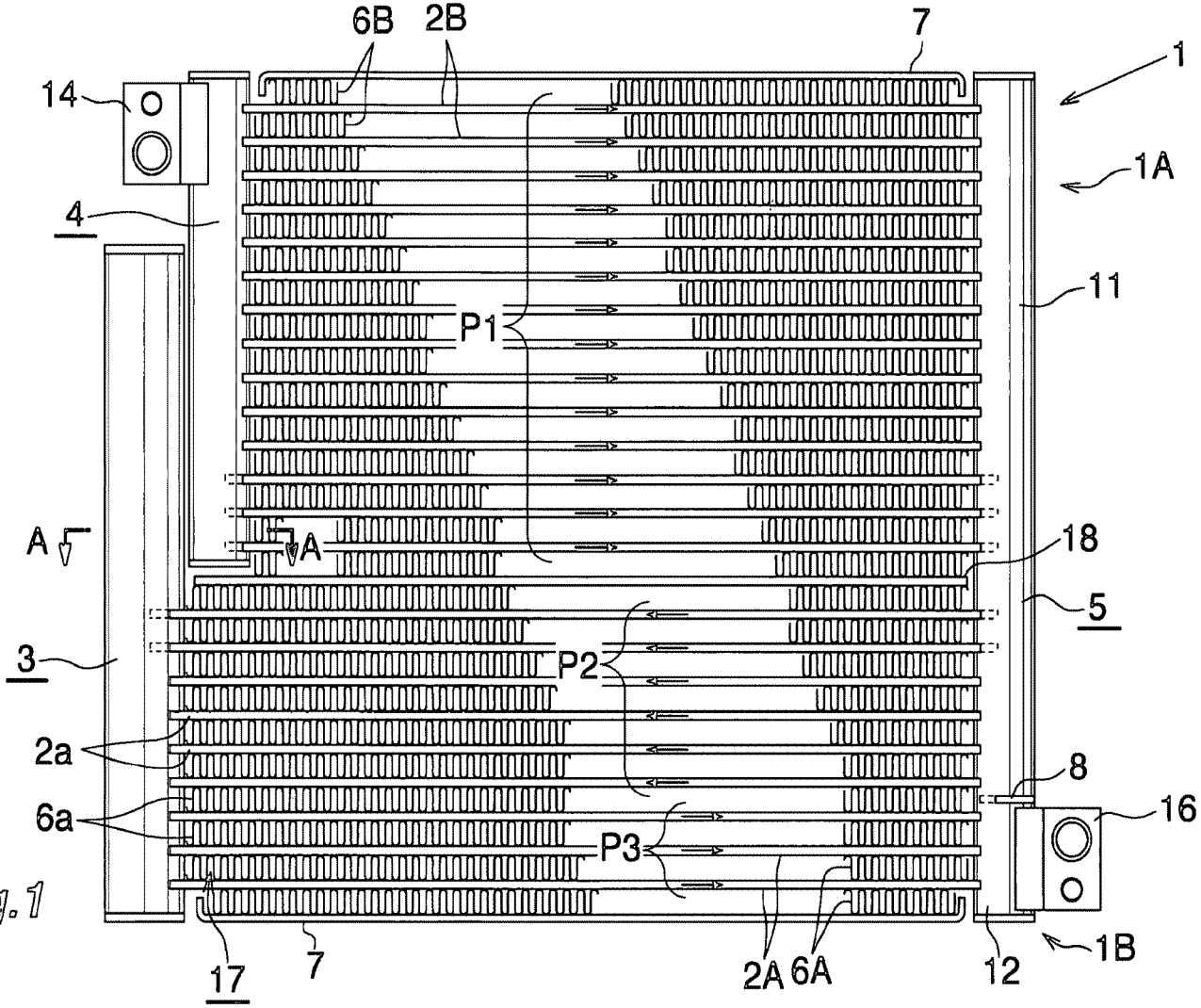
FIG. 1 is a front view specifically showing the overall structure of a first embodiment of the condenser according to the present invention.

In the following description, the direction toward the reverse side of a sheet on which FIG. 1 is drawn (the upper side in FIG. 2) will be referred to as the "front," and the opposite side as the "rear."

Furthermore, the term "aluminum" as used in the following description encompasses aluminum alloys in addition to pure aluminum.

Moreover, the same reference numerals are used throughout the drawings to refer to the same portions and members, and their repeated descriptions are omitted.

Figure 2:
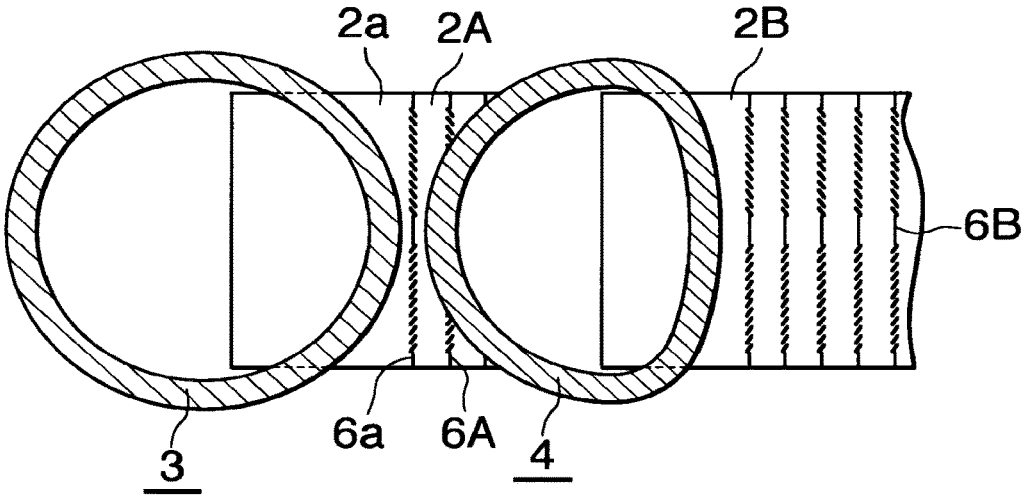
FIG. 2 is an enlarged sectional view taken along line A-A of FIG. 1.
Figure 3:
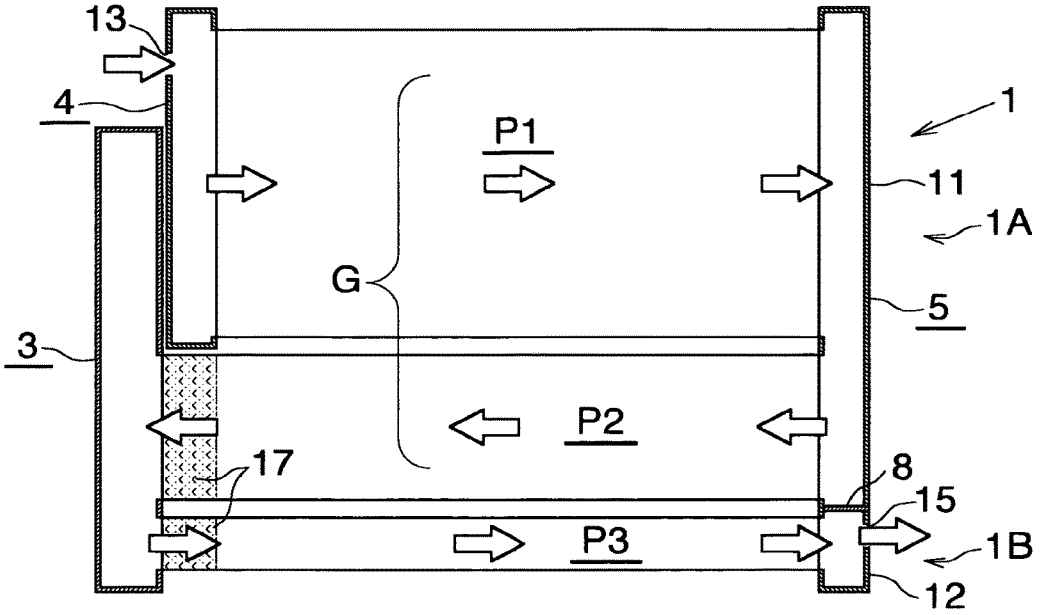
FIG. 3 is a front view schematically showing the condenser of FIG. 1.

FIG. 1 specifically shows the overall structure of a condenser according to the present invention; FIG. 2 shows the structure of a main portion thereof; and FIG. 3 schematically shows the condenser according to the present invention. In FIG. 3, individual heat exchange tubes are omitted, and corrugate fins, side plates, a refrigerant inlet member, and a refrigerant outlet member are also omitted.

In FIGS. 1 to 3, a condenser 1 includes a plurality of flat heat exchange tubes 2A, 2B formed of aluminum, three header tanks 3, 4, 5 formed of aluminum, corrugate fins 6A, 6B formed of aluminum, and side plates 7 formed of aluminum. The heat exchange tubes 2A, 2B are disposed such that their width direction coincides with a front-rear direction, their length direction coincides with a left-right direction, and they are spaced from one another in a vertical direction. Left and right end portions of the heat exchange tubes 2A, 2B are connected, by means of brazing, to the header tanks 3, 4, 5, which extend in the vertical direction. Each of the corrugate fins 6A, 6B is disposed between and brazed to adjacent heat exchange tubes 2A, 2B, or is disposed on the outer side of the uppermost or lowermost heat exchange tube 2A, 2B and brazed to the corresponding heat exchange tube 2A, 2B. The side plates 7 are disposed on the corresponding outer sides of the uppermost and lowermost corrugate fins 6A, 6B, and are brazed to these corrugate fins 6A, 6B. Two or more heat exchange paths (in the present embodiment, three heat exchange paths P1, P2, P3) each formed by a plurality of heat exchange tubes 2A, 2B successively arranged in the vertical direction are juxtaposed in the vertical direction. The three heat exchange paths will be referred to as the first to third heat exchange paths P1, P2, P3 from the upper side. The flow direction of refrigerant is the same among all the heat exchange tubes 2A, 2B which form the respective heat exchange paths P1, P2, P3. The flow direction of refrigerant in the heat exchange tubes 2A, 2B which form a certain heat exchange path is opposite the flow direction of refrigerant in the heat exchange tubes 2A, 2B which form another heat exchange path adjacent to the certain heat exchange path.

The condenser 1 includes a group G composed of at least two heat exchange paths which are successively arranged and which include the first heat exchange path P1 at the upper end (in the present embodiment, the first and second heat exchange paths P1, P2), and at least one heat exchange path (in the present embodiment, the third heat exchange path P3) is provided below the group G. In the group G, refrigerant flows from the first heat exchange path P1 at the upper end toward the second heat exchange path P2 at the lower end.

A first header tank 3 and a second header tank 4 are individually provided at the left end of the condenser 1. The heat exchange tubes 2A, which form the lower end heat exchange path located on the downstreammost side of the group G with respect to the refrigerant flow direction, and the heat exchange path located below the group G (in the present embodiment, the second and third heat exchange paths P2, P3), are connected to the first header tank 3 by means of brazing. The heat exchange tubes 2B, which form all the remaining heat exchange path(s) (in the present embodiment, the first heat exchange path P1), are connected to the second header tank 4 by means of brazing. Notably, the lower end of the first header tank 3 is located below the lower end of the second header tank 4, and the heat exchange tubes 2A, which form the second and third heat exchange paths P2, P3, are brazed to a portion of the first header tank 3 located below the second header tank 4.

The heat exchange tubes 2A connected to the first header tank 3 will be referred to as the first heat exchange tubes, and the heat exchange tubes 2B connected to the second header tank 4 will be referred to as the second heat exchange tubes. The corrugate fins 6A disposed between the adjacent first heat exchange tubes 2A and between the lower end first heat exchange tube 2A and the lower side plate 7 will be referred to as the first corrugate fins, and the corrugate fins 6B disposed between the adjacent second heat exchange tubes 2B and between the upper end second heat exchange tube 2B and the upper side plate 7 will be referred to as the second corrugate fins.

Although the first header tank 3 and the second header tank 4 are approximately equal to each other in terms of the dimension along the front-rear direction, the first header tank 3 is greater than the second header tank 4 in terms of the horizontal cross sectional area. The first header tank 3 is disposed on the left side (on the outer side with respect to the left-right direction) of the second header tank 4. The center lines of the first and second header tanks 3, 4 (the centers of the header tanks 3, 4 with respect to the front-rear direction) are located on a common vertical plane extending in the left-right direction. Therefore, the first header tank 3 and the second header tank 4 do not have portions overlapping each other as viewed in a horizontal cross section or as viewed from above. The upper end of the first header tank 3 is located above the lower end of the second header tank 4. The first header tank 3 serves as a liquid receiver which separates gas and liquid from each other through utilization of gravitational force, and stores the separated liquid. That is, the internal volume of the first header tank 3 is determined such that a portion of gas-liquid mixed phase refrigerant having flowed into the first header tank 3; i.e., liquid-predominant mixed phase refrigerant, remains in a lower region within the first header tank 3 because of gravitational force, and the gas phase component of the gas-liquid mixed phase refrigerant remains in an upper region within the first header tank 3 because of gravitational force, whereby only the liquid-predominant mixed phase refrigerant flows into the heat exchange tubes 2A of the third heat exchange path P3.

The third header tank 5 is disposed at the right end of the condenser 1, and all the heat exchange tubes 2A, 2B which form the first to third heat exchange paths P1-P3 are connected to the third header tank 5. The transverse cross sectional shape of the third header tank 5 is identical with that of the second header tank 4.

The interior of the third header tank 5 is divided into an upper header section 11 and a lower header section 12 by means of an aluminum partition plate 8 provided at a height between the second heat exchange path P2 and the third heat exchange path P3. A refrigerant inlet 13 is formed at an upper end portion of the second header tank 4, and a refrigerant outlet 15 is formed at the lower header section 12 of the third header tank 5. Thus, in the group G, refrigerant flows from the first heat exchange path P1 at the upper end toward the second heat exchange path P2 at the lower end as described above. Further, a refrigerant inlet member 14 which communicates with the refrigerant inlet 13 is joined to the second header tank 4, and a refrigerant outlet member 16 which communicates with the refrigerant outlet 15 is joined to the third header tank 5.

The second header tank 4, a portion of the first header tank 3 to which the first heat exchange tubes 2A of the second heat exchange path P2 are connected, the upper header section 11 of the third header tank 5, the first heat exchange path P1, and the second heat exchange path P2 form a condensation section 1A, which condensates refrigerant. A portion of the first header tank 3 to which the first heat exchange tubes 2A of the third heat exchange path P3 are connected, the lower header section 12 of the third header tank 5, and the third heat exchange path P3 form a super-cooling section 1B, which super-cools refrigerant. The first and second heat exchange paths P1, P2 (all the heat exchange paths of the group G) each serve as a refrigerant condensation path for condensing refrigerant. The third heat exchange path P3 located below the group G serves as a refrigerant super-cooling path for super-cooling refrigerant.

All the heat exchange tubes 2A 2B are straight, and left end portions (end portions on the side toward the first header tank 3) of the first heat exchange tubes 2A connected to the first header tank 3 extend leftward beyond left end portions (end portions on the side toward the second header tank 4) of the second heat exchange tubes 2B connected to the second header tank 4. Thus, the first heat exchange tubes 2A have, on the left side thereof (on the side toward the first header tank 3), projecting portions 2*a*, which project leftward (outward with respect to the left-right direction) beyond the left end portions of the second heat exchange tubes 2B. Furthermore, left end portions of the first corrugate fins 6A extend leftward beyond left end portions of the second corrugate fins 6B. Thus, the first corrugate fins 6A have, on the left side thereof, projecting portions 6*a*, which project leftward beyond the left end portions of the second corrugate fins 6B and are disposed between the projecting portions 2*a* of the adjacent first heat exchange tubes 2A. Thus, a heat exchange section 17 is formed by the projecting portions 2*a* of all the first heat exchange tubes 2A and the projecting portions 6*a* of all the first corrugate fins 6A. In FIG. 3, the heat exchange section 17 is indicated by tinting.

An intermediate member 18 formed of aluminum is disposed between the upper end first heat exchange tube 2A of the second heat exchange path P2 and the lower end second heat exchange tube 2B of the first heat exchange path P1 such that the intermediate member 18 is separated from these heat exchange tubes 2A, 2B, and becomes substantially parallel to the heat exchange tubes 2A, 2B. A first corrugate fin 6A is disposed between the upper end first heat exchange tube 2A of the second heat exchange path P2 and the intermediate member 18, and is brazed to the first heat exchange tube 2A and the intermediate member 18. A second corrugate fin 6B is disposed between the lower end second heat exchange tube 2B of the first heat exchange path P1 and the intermediate member 18, and is brazed to the second heat exchange tube 2B and the intermediate member 18. A tube completely identical with the second heat exchange tubes 2B is used as the intermediate member 18. Since opposite end portions of the intermediate member 18 are not inserted into the first header tank 3 and the third header tank 5, use of a tube completely identical with the second heat exchange tubes 2B becomes possible.

The condenser 1 is manufactured through batch brazing of all the components.

The condenser 1 constitutes a refrigeration cycle in cooperation with a compressor, an expansion valve (pressure reducer), and an evaporator; and the refrigeration cycle is mounted on a vehicle as a car air conditioner.

In the condenser 1 having the above-described structure, gas phase refrigerant of high temperature and high pressure compressed by the compressor flows into the second header tank 4 via the refrigerant inlet member 14 and the refrigerant inlet 13. The gas phase refrigerant is condensed while flowing rightward within the second heat exchange tubes 2B of the first heat exchange path P1, and flows into the upper header section 11 of the third header tank 5. The refrigerant having flowed into the upper header section 11 of the third header tank 5 is condensed while flowing leftward within the first heat exchange tubes 2A of the second heat exchange path P2, and flows into the first header tank 3.

The refrigerant having flowed into the first header tank 3 is gas-liquid mixed phase refrigerant. A portion of the gas-liquid mixed phase refrigerant; i.e., liquid-predominant mixed phase refrigerant, remains in a lower region within the first header tank 3 because of gravitational force, and enters the first heat exchange tubes 2A of the third heat exchange path P3. The liquid-predominant mixed phase refrigerant having entered the first heat exchange tubes 2A of the third heat exchange path P3 is super-cooled while flowing rightward within the first heat exchange tubes 2A. After that, the super-cooled refrigerant enters the lower header section 12 of the third header tank 5, and flows out via the refrigerant outlet 15 and the refrigerant outlet member 16. The refrigerant is then fed to the evaporator via the expansion valve.

Meanwhile, the gas phase component of the gas-liquid mixed phase refrigerant having flowed into the first header tank 3 remains in an upper region within the first header tank 3.

FIGS. 4 to 14 show other embodiments of the condenser according to the present invention. Notably, in FIGS. 4 to 6 and 9 to 14, which schematically show the condenser, the individual heat exchange tubes are omitted, and the corrugate fins, the side plates, the refrigerant inlet member, and the refrigerant outlet member are also omitted.

Figure 4:
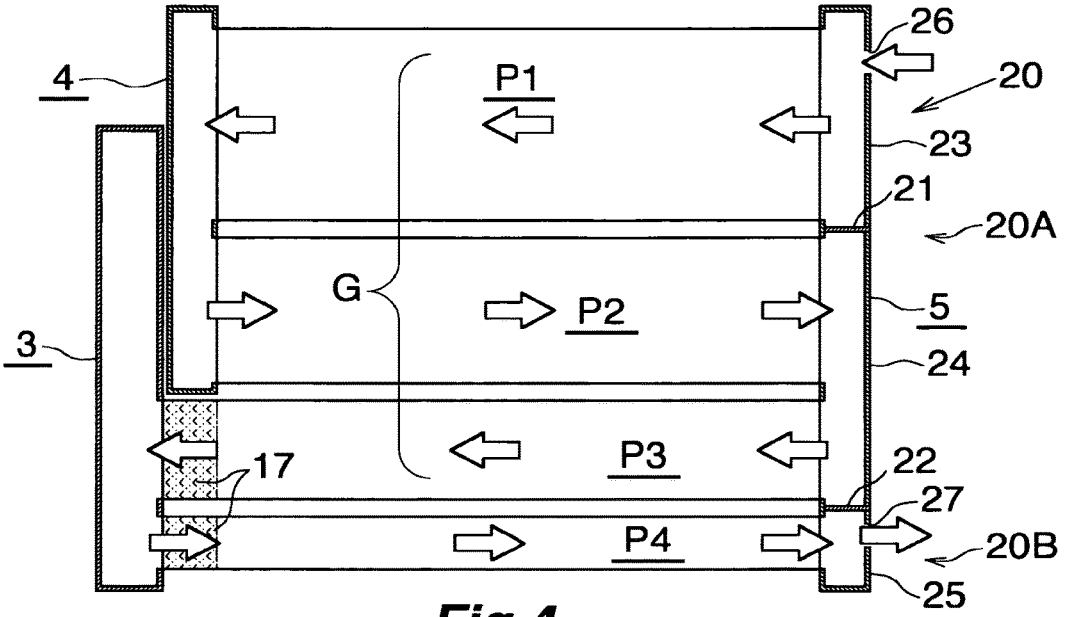
FIG. 4 is a front view schematically showing a second embodiment of the condenser according to the present invention.

In the case of a condenser 20 shown in FIG. 4, four heat exchange paths P1, P2, P3, P4 each formed by a plurality of heat exchange tubes 2A, 2B successively arranged in the vertical direction are juxtaposed in the vertical direction. The four heat exchange paths will be referred to as the first to fourth heat exchange paths P1, P2, P3, P4 from the upper side. The flow direction of refrigerant is the same among all the heat exchange tubes 2A, 2B which form the respective heat exchange paths P1, P2, P3, P4. The flow direction of refrigerant in the heat exchange tubes 2A, 2B which form a certain heat exchange path is opposite the flow direction of refrigerant in the heat exchange tubes 2A, 2B which form another heat exchange path adjacent to the certain heat exchange path.

The condenser 20 includes a group G composed of at least two heat exchange paths which are successively arranged and which include the first heat exchange path P1 at the upper end (in the present embodiment, the first through third heat exchange paths P1, P2, P3), and at least one heat exchange path (in the present embodiment, the fourth heat exchange path P4) is provided below the group G. In the group G, refrigerant flows from the first heat exchange path P1 at the upper end toward the third heat exchange path P3 at the lower end.

Left and right end portions of the heat exchange tubes 2A, which form the lower end heat exchange path located on the downstreammost side of the group G with respect to the refrigerant flow direction, and the heat exchange path located below the group G (in the present embodiment, the third and fourth heat exchange paths P3, P4), are connected to the first header tank 3 and the third header tank 5, respectively, by means of brazing. Left and right end portions of the heat exchange tubes 2B, which form all the remaining heat exchange paths (in the present embodiment, the first and second heat exchange paths P1, P2), are connected to the second header tank 4 and the third header tank 5, respectively, by means of brazing. Therefore, the heat exchange tubes 2A, which form the third and fourth heat exchange paths P3, P4, are the first heat exchange tubes, and the heat exchange tubes 2B, which form the first and second heat exchange paths P1, P2, are the second heat exchange tubes.

The interior of the third header tank 5 is divided into an upper header section 23, an intermediate header section 24, and a lower header section 25 by aluminum partition plates 21 and 22, which are provided at a height between the first heat exchange path P1 and the second heat exchange path P2 and a height between the third heat exchange path P3 and the fourth heat exchange path P4, respectively. A refrigerant inlet 26 is formed at the upper header section 23 of the third header tank 5, and a refrigerant outlet 27 is formed at the lower header section 25 of the third header tank 5. Left end portions of the second heat exchange tubes 2B of the first heat exchange path P1 are connected to the second header tank 4, and right end portions thereof are connected to the upper header section 23 of the third header tank 5. Left end portions of the second heat exchange tubes 2B of the second heat exchange path P2 are connected to the second header tank 4, and right end portions thereof are connected to the intermediate header section 24 of the third header tank 5. Left end portions of the first heat exchange tubes 2A of the third heat exchange path P3 are connected to the first header tank 3, and right end portions thereof are connected to the intermediate header section 24 of the third header tank 5. Left end portions of the first heat exchange tubes 2A of the fourth heat exchange path P4 are connected to the first header tank 3, and right end portions thereof are connected to the lower header section 25 of the third header tank 5. As a result, in the group G, refrigerant flows from the first heat exchange path P1 at the upper end toward the third heat exchange path P3 at the lower end, as described above. Notably, a refrigerant inlet member (not shown) which communicates with the refrigerant inlet 26 and a refrigerant outlet member (not shown) which communicates with the refrigerant outlet 27 are joined to the third header tank 5.

The second header tank 4, a portion of the first header tank 3 to which the first heat exchange tubes 2A of the third heat exchange path P3 are connected, the upper and intermediate header sections 23 and 24 of the third header tank 5, and the first to third heat exchange paths P1-P3 form a condensation section 20A, which condenses refrigerant. A portion of the first header tank 3 to which the first heat exchange tubes 2A of the fourth heat exchange path P4 are connected, the lower header section 25 of the third header tank 5, and the fourth heat exchange path P4 form a super-cooling section 20B, which super-cools refrigerant. The first to third heat exchange paths P1-P3, which are all the heat exchange paths of the group G, each serve as a refrigerant condensation path for condensing refrigerant, and the fourth heat exchange path P4 located below the group G serves as a refrigerant super-cooling path for super-cooling refrigerant.

Although not illustrated, in the condenser 20 shown in FIG. 4, an intermediate member 18 formed of aluminum is disposed between the upper end first heat exchange tube 2A of the third heat exchange path P3 and the lower end second heat exchange tube 2B of the second heat exchange path P2 such that the intermediate member 18 is separated from these heat exchange tubes 2A, 2B and becomes substantially parallel to the heat exchange tubes 2A, 2B. A first corrugate fin 6A is disposed between the upper end first heat exchange tube 2A of the third heat exchange path P3 and the intermediate member 18, and is brazed to the first heat exchange tube 2A and the intermediate member 18. A second corrugate fin 6B is disposed between the lower end second heat exchange tube 2B of the second heat exchange path P2 and the intermediate member 18, and is brazed to the second heat exchange tube 2B and the intermediate member 18.

The remaining structure is similar to that of the condenser shown in FIGS. 1 to 3.

In the condenser 20 shown in FIG. 4, gas phase refrigerant of high temperature and high pressure compressed by the compressor flows into the upper header section 23 of the third header tank 5 via the refrigerant inlet member and the refrigerant inlet 26. The gas phase refrigerant is condensed while flowing leftward within the second heat exchange tubes 2B of the first heat exchange path P1, and then flows into the second header tank 4. The refrigerant having flowed into the second header tank 4 is condensed while flowing rightward within the second heat exchange tubes 2B of the second heat exchange path P2, and then flows into the intermediate header section 24 of the third header tank 5. The refrigerant having flowed into the intermediate header section 24 of the third header tank 5 is condensed while flowing leftward within the first heat exchange tubes 2A of the third heat exchange path P3, and then flows into the first header tank 3.

The refrigerant having flowed into the first header tank 3 is gas-liquid mixed phase refrigerant. A portion of the gas-liquid mixed phase refrigerant; i.e., liquid-predominant mixed phase refrigerant, remains in a lower region within the first header tank 3 because of gravitational force, and enters the first heat exchange tubes 2A of the fourth heat exchange path P4. The liquid-predominant mixed phase refrigerant having entered the first heat exchange tubes 2A of the fourth heat exchange path P4 is super-cooled while flowing rightward within the first heat exchange tubes 2A. After that, the super-cooled refrigerant enters the lower header section 25 of the third header tank 5, and flows out via the refrigerant outlet 27 and the refrigerant outlet member. The refrigerant is then fed to the evaporator via the expansion valve.

Meanwhile, the gas phase component of the gas-liquid mixed phase refrigerant having flowed into the first header tank 3 remains in an upper region within the first header tank 3.

Figure 5:
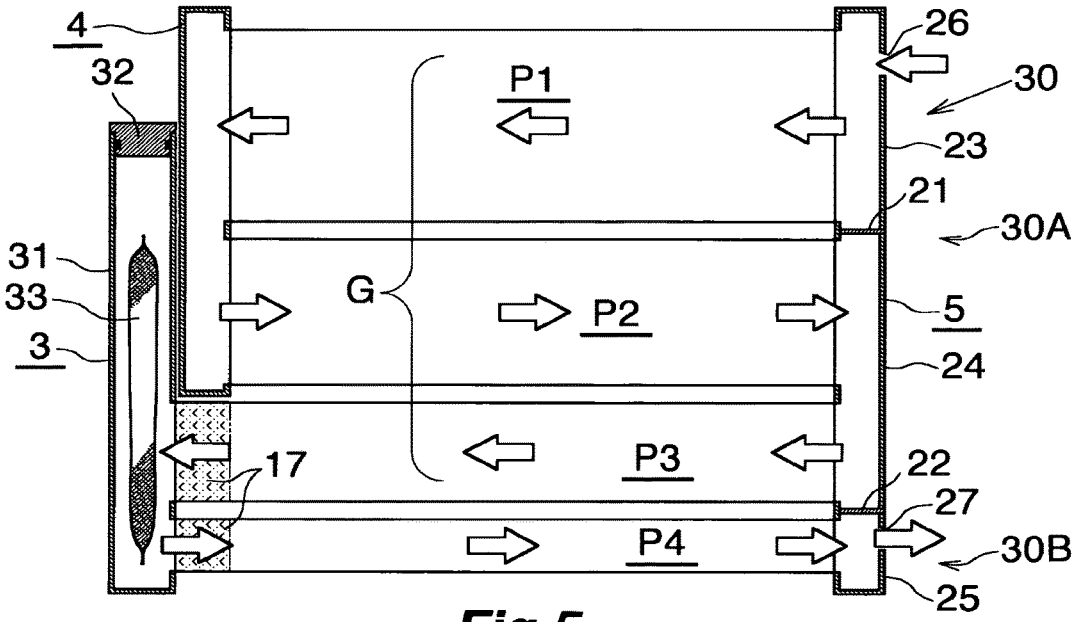
FIG. 5 is a front view schematically showing a third embodiment of the condenser according to the present invention.

In the case of a condenser 30 shown in FIG. 5, the first header tank 3 is composed of a tubular main body 31, which is formed of aluminum and which has an open upper end and a closed lower end; and a lid 32, which is removably attached to the upper end of the tubular main body 31 so as to close the upper end opening of the tubular main body 31. When the condenser 30 is manufactured, only the tubular main body 31 undergoes batch brazing simultaneously with other members. After manufacture of the condenser 30, the lid 32 is attached to the tubular main body 31.

Furthermore, a desiccant 33 is disposed in the first header tank 3. The desiccant 33 removes moisture from the refrigerant flowing into the first header tank 3 via the first heat exchange tubes 2A of the third heat exchange path P3. The desiccant 33 is placed in the tubular main body 31 after manufacture of the condenser 30 but before attachment of the lid 32 to the tubular main body 31.

The remaining structure is similar to that of the condenser 20 shown in FIG. 4, and refrigerant flows in the same manner as in the case of the condenser 20 shown in FIG. 4. Notably, in FIG. 5, a condensation section having a configuration similar to that of the condenser 20 shown in FIG. 4 will be denoted by 30A, and a super-cooling section having a configuration similar to that of the condenser 20 shown in FIG. 4 is denoted by 30B.

Figure 6:
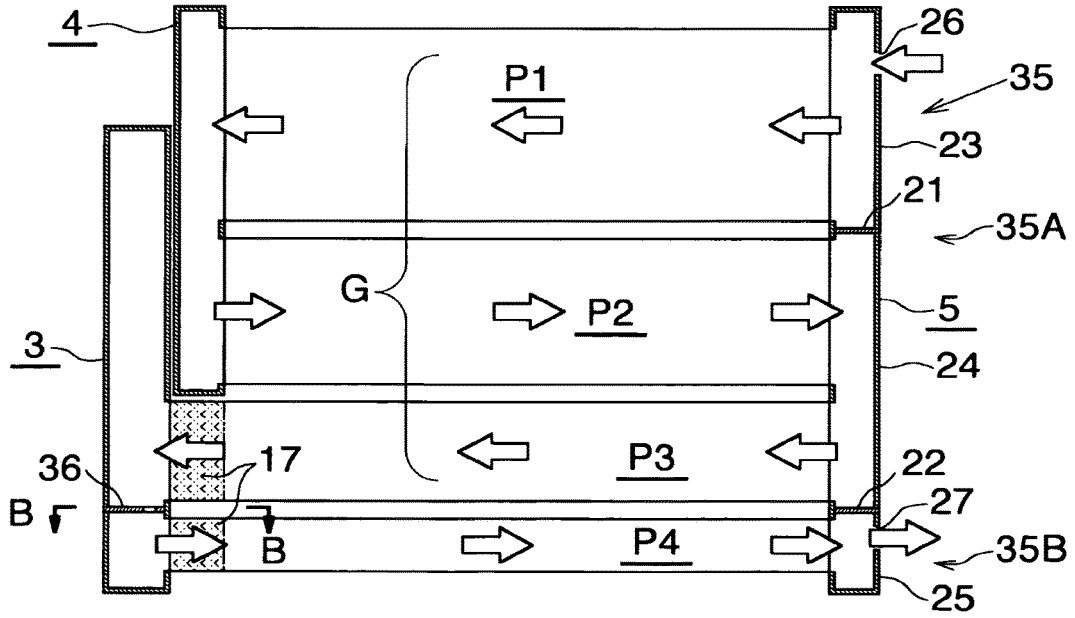
FIG. 6 is a front view schematically showing a fourth embodiment of the condenser according to the present invention.
Figure 7:
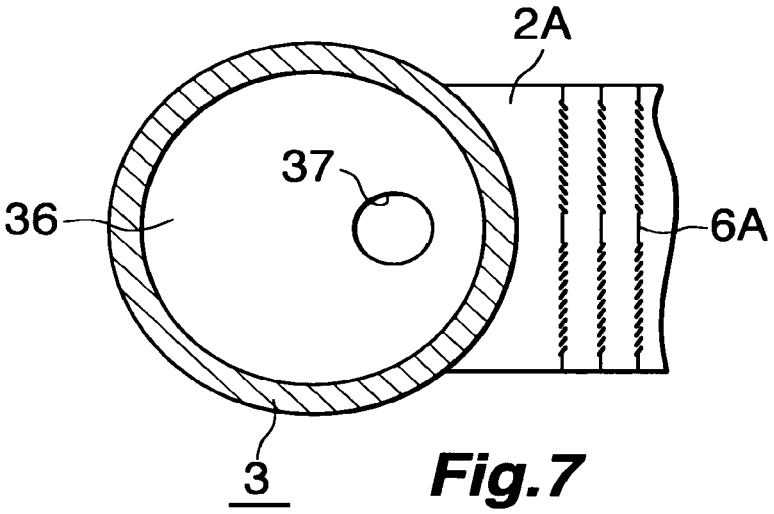
FIG. 7 is an enlarged sectional view taken along line B-B of FIG. 6.

In the case of a condenser 35 shown in FIGS. 6 and 7, a gas-liquid separation member 36 formed of aluminum is disposed within the first header tank 3 at a height between the third heat exchange path P3 and the fourth heat exchange path P4. The gas-liquid separation member 36 assumes a plate-like shape, and has a rectifying through hole 37 formed therein. The gas-liquid separation member 36 prevents the influence of agitating swirls, generated by the flow of the refrigerant flowing from the first heat exchange tubes 2A of the third heat exchange path P3 into the first header tank 3, from propagating to a portion of the interior of the first header tank 3 located below the gas-liquid separation member 36, to thereby cause the gas phase component of the gas-liquid mixed phase refrigerant to stay in the upper portion of the interior of the first header tank 3. As a result, only the liquid-predominant mixed phase refrigerant is fed to the portion of the interior of the first header tank 3 located below the gas-liquid separation member 36 via the rectifying through hole 37, whereby the liquid-predominant mixed phase refrigerant effectively flows into the first heat exchange tubes 2A of the fourth heat exchange path P4.

Notably, a desiccant 33 may be disposed in a portion of the first header tank 3 above the gas-liquid separation member 36. In this case, like the case of the condenser 30 shown in FIG. 5, the first header tank 3 is composed of a tubular main body 31, which is formed of aluminum and which has an open upper end and a closed lower end; and a lid 32, which is removably attached to the upper end of the tubular main body 31 so as to close the upper end opening of the tubular main body 31. When the condenser 30 is manufactured, only the tubular main body 31 undergoes batch brazing simultaneously with other members. The lid 32 is attached to the tubular main body 31 after the desiccant 33 is placed in the tubular main body 31 after manufacture of the condenser 30.

The remaining structure is similar to that of the condenser 20 shown in FIG. 4, and refrigerant flows in the same manner as in the case of the condenser 20 shown in FIG. 4.

Notably, in FIGS. 6 and 7, a condensation section having a configuration similar to that of the condenser 20 shown in FIG. 4 will be denoted by 35A, and a super-cooling section having a configuration similar to that of the condenser 20 shown in FIG. 4 is denoted by 35B.

Figure 8:
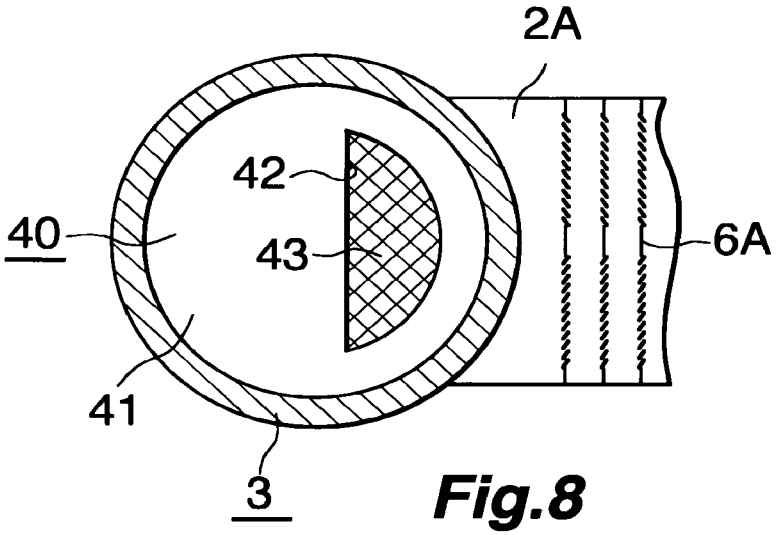
FIG. 8 is a view corresponding to FIG. 7 and showing a modification of the first header tank of the condenser shown in FIG. 6.

In the condenser 35 shown in FIGS. 6 and 7, instead of the gas-liquid separation member 36, a filter 40 as shown in FIG. 8 may be disposed within the first header tank 3 at a height between the third heat exchange path P3 and the fourth heat exchange path P4. The filter 40 is composed of an aluminum plate-like body 41 having a through hole 42, and a stainless steel mesh 43 fixed to the body 41 to cover the through hole 42. In this case, foreign objects contained in refrigerant can be removed.

Figure 9:
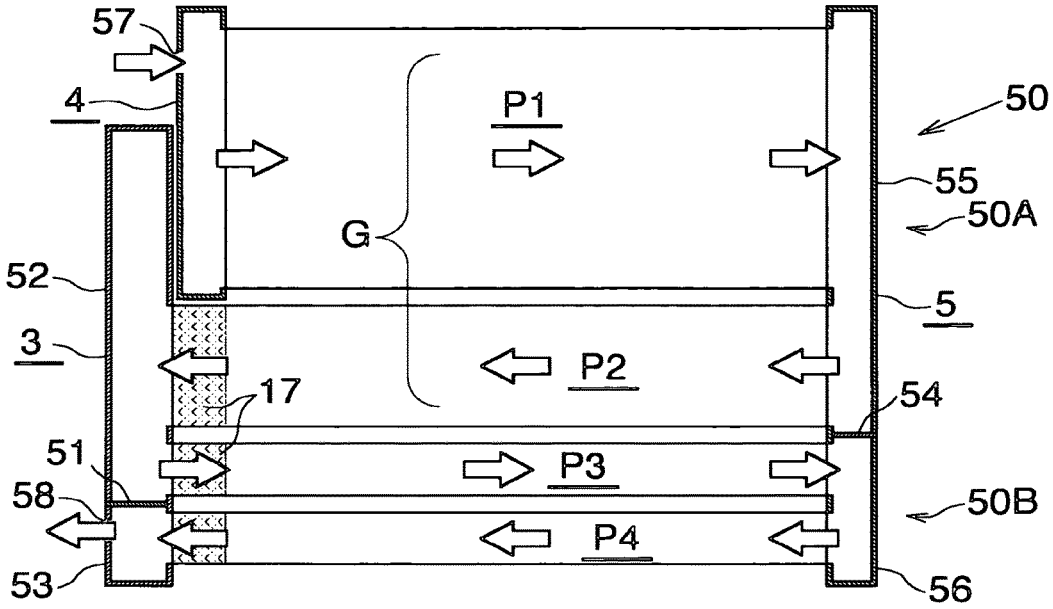
FIG. 9 is a front view schematically showing a fifth embodiment of the condenser according to the present invention.

In the case of a condenser 50 shown in FIG. 9, four heat exchange paths P1, P2, P3, P4 each formed by a plurality of heat exchange tubes 2A, 2B successively arranged in the vertical direction are juxtaposed in the vertical direction. The four heat exchange paths will be referred to as the first to fourth heat exchange paths P1, P2, P3, P4 from the upper side. The flow direction of refrigerant is the same among all the heat exchange tubes 2A, 2B which form the respective heat exchange paths P1, P2, P3, P4. The flow direction of refrigerant in the heat exchange tubes 2A, 2B which form a certain heat exchange path is opposite the flow direction of refrigerant in the heat exchange tubes 2A, 2B which form another heat exchange path adjacent to the certain heat exchange path.

The condenser 50 includes a group G composed of at least two heat exchange paths which are successively arranged and which include the first heat exchange path P1 at the upper end (in the present embodiment, the first and second heat exchange paths P1, P2), and at least one heat exchange path (in the present embodiment, the third and fourth heat exchange paths P3, P4) is provided below the group G. In the group G, refrigerant flows from the first heat exchange path P1 at the upper end toward the second heat exchange path P2 at the lower end.

Left and right end portions of the heat exchange tubes 2A, which form the lower end heat exchange path located on the downstreammost side of the group G with respect to the refrigerant flow direction, and the heat exchange paths located below the group G (in the present embodiment, the second through fourth heat exchange paths P2, P3, P4), are connected to the first header tank 3 and the third header tank 5, respectively, by means of brazing. Left and right end portions of the heat exchange tubes 2B, which form all the remaining heat exchange path(s) (in the present embodiment, the first heat exchange path P1), are connected to the second header tank 4 and the third header tank 5, respectively, by means of brazing. Therefore, the heat exchange tubes 2A, which form the second through fourth heat exchange paths P2, P3, P4, are the first heat exchange tubes, and the heat exchange tubes 2B, which form the first heat exchange path P1, are the second heat exchange tubes.

The interior of the first header tank 3 is divided into an upper header section 52 and a lower header section 53 by an aluminum partition plate 51 provided at a height between the third heat exchange path P3 and the fourth heat exchange path P4. The interior of the third header tank 5 is divided into an upper header section 55 and a lower header section 56 by an aluminum partition plates 54 provided at a height between the second heat exchange path P2 and the third heat exchange path P3. A refrigerant inlet 57 is formed at a upper end portion of the second header tank 4, and a refrigerant outlet 58 is formed at the lower header section 53 of the first header tank 3. Left end portions of the second heat exchange tubes 2B of the first heat exchange path P1 are connected to the second header tank 4, and right end portions thereof are connected to the upper header section 55 of the third header tank 5. Left end portions of the first heat exchange tubes 2A of the second heat exchange path P2 are connected to the upper header section 52 of the first header tank 3, and right end portions thereof are connected to the upper header section 55 of the third header tank 5. Left end portions of the first heat exchange tubes 2A of the third heat exchange path P3 are connected to the upper header section 52 of the first header tank 3, and right end portions thereof are connected to the lower header section 56 of the third header tank 5. Left end portions of the first heat exchange tubes 2A of the fourth heat exchange path P4 are connected to the lower header section 53 of the first header tank 3, and right end portions thereof are connected to the lower header section 56 of the third header tank 5. As a result, in the group G, refrigerant flows from the first heat exchange path P1 at the upper end toward the second heat exchange path P2 at the lower end, as described above. Notably, a refrigerant inlet member (not shown) which communicates with the refrigerant inlet 57 is joined to the second header tank 4, and a refrigerant outlet member (not shown) which communicates with the refrigerant outlet 58 is joined to the first header tank 3.

The second header tank 4, a portion of the first header tank 3 to which the first heat exchange tubes 2A of the second heat exchange path P2 are connected, the upper header section 55 of the third header tank 5, and the first and second heat exchange paths P1, P2 form a condensation section 50A, which condenses refrigerant. A portion of the first header tank 3 to which the first heat exchange tubes 2A of the third and fourth heat exchange paths P3, P4 are connected, the lower header section 56 of the third header tank 5, and the third and fourth heat exchange paths P3, P4 form a super-cooling section 50B, which super-cools refrigerant. The first and second heat exchange paths P1, P2, which are all the heat exchange paths of the group G, each serve as a refrigerant condensation path for condensing refrigerant, and the third and fourth heat exchange paths P3, P4, which are located below the group G, each serve as a refrigerant super-cooling path for super-cooling refrigerant.

Although not illustrated, in the condenser 50 shown in FIG. 9, an intermediate member 18 formed of aluminum is disposed between the upper end first heat exchange tube 2A of the second heat exchange path P2 and the lower end second heat exchange tube 2B of the first heat exchange path P1 such that the intermediate member 18 is separated from these heat exchange tubes 2A, 2B and becomes substantially parallel to the heat exchange tubes 2A, 2B. A first corrugate fin 6A is disposed between the upper end first heat exchange tube 2A of the second heat exchange path P2 and the intermediate member 18, and is brazed to the first heat exchange tube 2A and the intermediate member 18. A second corrugate fin 6B is disposed between the lower end second heat exchange tube 2B of the first heat exchange path P1 and the intermediate member 18, and is brazed to the second heat exchange tube 2B and the intermediate member 18.

The remaining structure is similar to that of the condenser shown in FIGS. 1 to 3.

In the condenser 50 shown in FIG. 9, gas phase refrigerant of high temperature and high pressure compressed by the compressor flows into the second header tank 4 via the refrigerant inlet member and the refrigerant inlet 57. The gas phase refrigerant is condensed while flowing rightward within the second heat exchange tubes 2B of the first heat exchange path P1, and then flows into the upper header section 55 of the third header tank 5. The refrigerant having flowed into the upper header section 55 of the third header tank 5 is condensed while flowing leftward within the first heat exchange tubes 2A of the second heat exchange path P2, and then flows into the upper header section 52 of the first header tank 3.

The refrigerant having flowed into the upper header section 52 of the first header tank 3 is gas-liquid mixed phase refrigerant. A portion of the gas-liquid mixed phase refrigerant; i.e., liquid-predominant mixed phase refrigerant, remains in a lower region within the upper header section 52 of the first header tank 3 because of gravitational force, and enters the first heat exchange tubes 2A of the third heat exchange path P3. The liquid-predominant mixed phase refrigerant having entered the first heat exchange tubes 2A of the third heat exchange path P3 is super-cooled while flowing rightward within the first heat exchange tubes 2A, and flows into the lower header section 56 of the third header tank 5. The liquid-predominant mixed phase refrigerant having flowed into the lower header section 56 of the third header tank 5 is super-cooled while flowing leftward within the first heat exchange tubes 2A of the fourth heat exchange path P4. After that, the super-cooled refrigerant enters the lower header section 53 of the first header tank 3, and flows out via the refrigerant outlet 58 and the refrigerant outlet member. The refrigerant is then fed to the evaporator via the expansion valve.

Meanwhile, the gas phase component of the gas-liquid mixed phase refrigerant having flowed into the upper header section 52 of the first header tank 3 remains in an upper region within the upper header section 52 of the first header tank 3.

Figure 10:
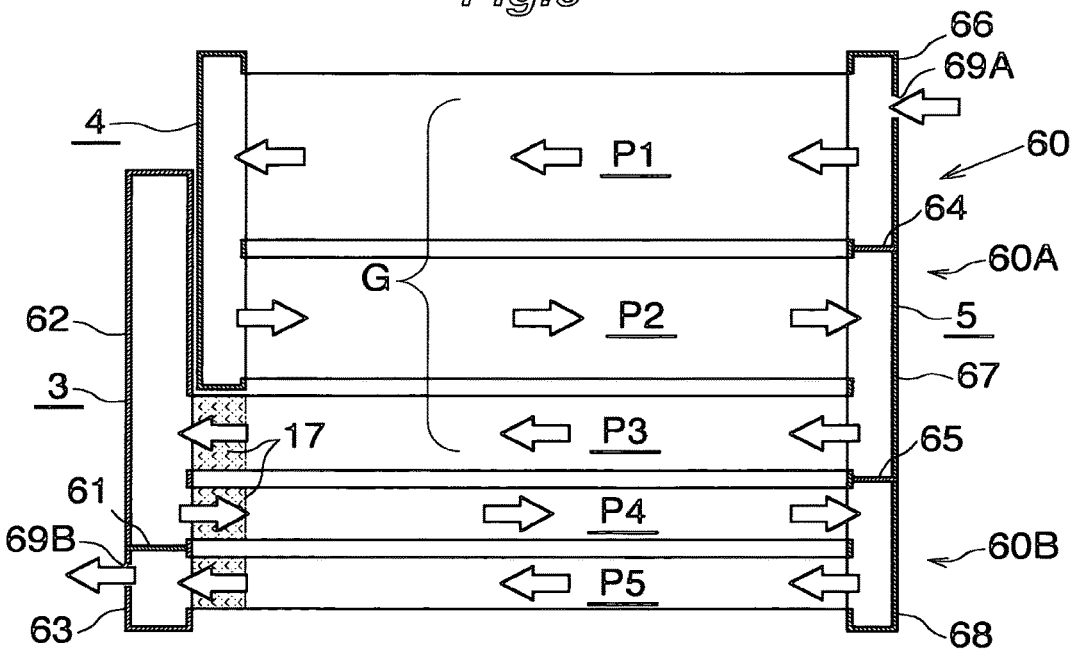
FIG. 10 is a front view schematically showing a sixth embodiment of the condenser according to the present invention.

In the case of a condenser 60 shown in FIG. 10, five heat exchange paths P1, P2, P3, P4, P5 each formed by a plurality of heat exchange tubes 2A, 2B successively arranged in the vertical direction are juxtaposed in the vertical direction. The five heat exchange paths will be referred to as the first to fifth heat exchange paths P1, P2, P3, P4, P5 from the upper side. The flow direction of refrigerant is the same among all the heat exchange tubes 2A, 2B which form the respective heat exchange paths P1, P2, P3, P4, P5. The flow direction of refrigerant in the heat exchange tubes 2A, 2B which form a certain heat exchange path is opposite the flow direction of refrigerant in the heat exchange tubes 2A, 2B which form another heat exchange path adjacent to the certain heat exchange path.

The condenser 60 includes a group G composed of at least two heat exchange paths which are successively arranged and which include the first heat exchange path P1 at the upper end (in the present embodiment, the first through third heat exchange paths P1, P2, P3), and at least one heat exchange path (in the present embodiment, the fourth and fifth heat exchange path P4, P5) is provided below the group G. In the group G, refrigerant flows from the first heat exchange path P1 at the upper end toward the third heat exchange path P3 at the lower end.

Left and right end portions of the heat exchange tubes 2A, which form the lower end heat exchange path located on the downstreammost side of the group G with respect to the refrigerant flow direction, and the heat exchange path located below the group G (in the present embodiment, the third through fifth heat exchange paths P3, P4, P5), are connected to the first header tank 3 and the third header tank 5, respectively, by means of brazing. Left and right end portions of the heat exchange tubes 2B, which form all the remaining heat exchange paths (in the present embodiment, the first and second heat exchange paths P1, P2), are connected to the second header tank 4 and the third header tank 5, respectively, by means of brazing. Therefore, the heat exchange tubes 2A, which form the third through fifth heat exchange paths P3, P4, P5 are the first heat exchange tubes, and the heat exchange tubes 2B, which form the first and second heat exchange paths P1, P2, are the second heat exchange tubes.

The interior of the first header tank 3 is divided into an upper header section 62 and a lower header section 63 by an aluminum partition plate 61, which is provided at a height between the fourth heat exchange path P4 and the fifth heat exchange path P5. The interior of the third header tank 5 is divided into an upper header section 66, an intermediate header section 67, and a lower header section 68 by aluminum partition plates 64 and 65, which are provided at a height between the first heat exchange path P1 and the second heat exchange path P2 and a height between the third heat exchange path P3 and the fourth heat exchange path P4, respectively. A refrigerant inlet 69A is formed at the upper header section 66 of the third header tank 5, and a refrigerant outlet 69B is formed at the lower header section 63 of the first header tank 3, which constitutes a super-cooling section 60B. Left end portions of the second heat exchange tubes 2B of the first heat exchange path P1 are connected to the second header tank 4, and right end portions thereof are connected to the upper header section 66 of the third header tank 5. Left end portions of the second heat exchange tubes 2B of the second heat exchange path P2 are connected to the second header tank 4, and right end portions thereof are connected to the intermediate header section 67 of the third header tank 5. Left end portions of the first heat exchange tubes 2A of the third heat exchange path P3 are connected to the upper header section 62 of the first header tank 3, and right end portions thereof are connected to the intermediate header section 67 of the third header tank 5. Left end portions of the first heat exchange tubes 2A of the fourth heat exchange path P4 are connected to the upper header section 62 of the first header tank 3, and right end portions thereof are connected to the lower header section 68 of the third header tank 5. Left end portions of the first heat exchange tubes 2A of the fifth heat exchange path P5 are connected to the lower header section 63 of the first header tank 3, and right end portions thereof are connected to the lower header section 68 of the third header tank 5. As a result, in the group G, refrigerant flows from the first heat exchange path P1 at the upper end toward the third heat exchange path P3 at the lower end, as described above. Notably, a refrigerant inlet member (not shown) which communicates with the refrigerant inlet 69A is joined to the third header tank 5, and a refrigerant outlet member (not shown) which communicates with the refrigerant outlet 69B is joined to the first header tank 3.

Although not illustrated, in the condenser 60 shown in FIG. 10, an intermediate member 18 formed of aluminum is disposed between the upper end first heat exchange tube 2A of the third heat exchange path P3 and the lower end second heat exchange tube 2B of the second heat exchange path P2 such that the intermediate member 18 is separated from these heat exchange tubes 2A, 2B and becomes substantially parallel to the heat exchange tubes 2A, 2B. A first corrugate fin 6A is disposed between the upper end first heat exchange tube 2A of the third heat exchange path P3 and the intermediate member 18, and is brazed to the first heat exchange tube 2A and the intermediate member 18. A second corrugate fin 6B is disposed between the lower end second heat exchange tube 2B of the second heat exchange path P2 and the intermediate member 18, and is brazed to the second heat exchange tube 2B and the intermediate member 18.

The remaining structure is similar to that of the condenser shown in FIGS. 1 to 3.

In the condenser 60 shown in FIG. 10, gas phase refrigerant of high temperature and high pressure compressed by the compressor flows into the upper header section 66 of the third header tank 5 via the refrigerant inlet member and the refrigerant inlet 69A. The gas phase refrigerant is condensed while flowing leftward within the second heat exchange tubes 2B of the first heat exchange path P1, and then flows into the second header tank 4. The refrigerant having flowed into the second header tank 4 is condensed while flowing rightward within the second heat exchange tubes 2B of the second heat exchange path P2, and then flows into the intermediate header section 67 of the third header tank 5. The refrigerant having flowed into the intermediate header section 67 of the third header tank 5 is condensed while flowing leftward within the first heat exchange tubes 2A of the third heat exchange path P3, and then flows into the upper header section 62 of the first header tank 3.

The refrigerant having flowed into the upper header section 62 of the first header tank 3 is gas-liquid mixed phase refrigerant. A portion of the gas-liquid mixed phase refrigerant; i.e., liquid-predominant mixed phase refrigerant, remains in a lower region within the upper header section 62 of the first header tank 3 because of gravitational force, and enters the first heat exchange tubes 2A of the fourth heat exchange path P4. The liquid-predominant mixed phase refrigerant having entered the first heat exchange tubes 2A of the fourth heat exchange path P4 is super-cooled while flowing rightward within the first heat exchange tubes 2A. After that, the super-cooled refrigerant enters the lower header section 68 of the third header tank 5. The liquid-predominant mixed phase refrigerant having entered the lower header section 68 of the third header tank 5 is super-cooled while flowing leftward within the first heat exchange tubes 2A of the fifth heat exchange path P5, and flows into the lower header section 63 of the first header thank 3. After that, the refrigerant flows out via the refrigerant outlet 69B and the refrigerant outlet member, and is then fed to the evaporator via the expansion valve.

Meanwhile, the gas phase component of the gas-liquid mixed phase refrigerant having flowed into the upper header section 62 of the first header tank 3 remains in an upper region within the upper header section 62 of the first header tank 3.

Figure 11:
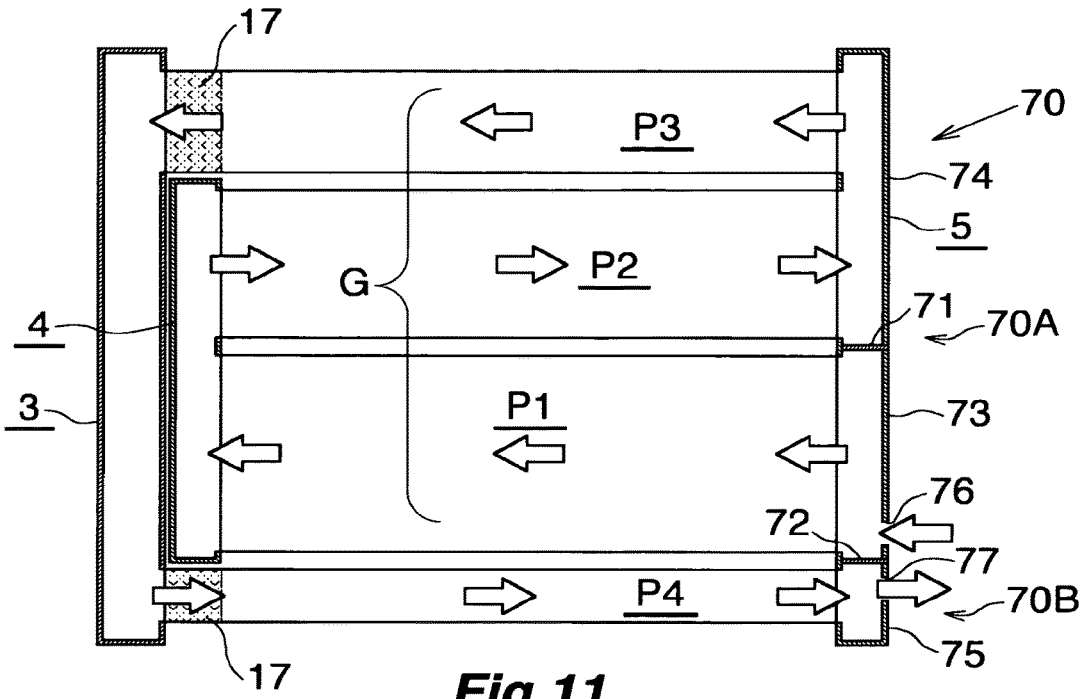
FIG. 11 is a front view schematically showing a seventh embodiment of the condenser according to the present invention.

In the case of a condenser 70 shown in FIG. 11, four heat exchange paths P1, P2, P3, P4 each formed by a plurality of heat exchange tubes 2A, 2B successively arranged in the vertical direction are juxtaposed in the vertical direction. The three upper side heat exchange paths will be referred to as the first to third heat exchange paths P1, P2, P3 from the lower side. The heat exchange path at the lower end will be referred to as the fourth heat exchange path P4. The flow direction of refrigerant is the same among all the heat exchange tubes 2A, 2B which form the respective heat exchange paths P1, P2, P3, P4. The flow direction of refrigerant in the heat exchange tubes 2A, 2B which form a certain heat exchange path is opposite the flow direction of refrigerant in the heat exchange tubes 2A, 2B which form another heat exchange path adjacent to the certain heat exchange path.

The condenser 70 includes a group G composed of at least two heat exchange paths which are successively arranged and which include the third heat exchange path P3 at the upper end (in the present embodiment, the first through third heat exchange paths P1, P2, P3), and at least one heat exchange path (in the present embodiment, the fourth heat exchange path P4) is provided below the group G. In the group G, refrigerant flows from the first heat exchange path P1 at the lower end toward the third heat exchange path P3 at the upper end.

Left and right end portions of the heat exchange tubes 2A, which form the upper end heat exchange path located on the downstreammost side of the group G with respect to the refrigerant flow direction, and the heat exchange paths located below the group G (in the present embodiment, the third and fourth heat exchange paths P3, P4), are connected to the first header tank 3 and the third header tank 5, respectively, by means of brazing. Left and right end portions of the heat exchange tubes 2B, which form all the remaining heat exchange paths (in the present embodiment, the first and second heat exchange paths P1, P2), are connected to the second header tank 4 and the third header tank 5, respectively, by means of brazing. Notably, the upper end of the first header tank 3 is located above the upper end of the second header tank 4, and the lower end of the first header tank 3 is located below the lower end of the second header tank 4. The heat exchange tubes 2A which form the upper end third heat exchange path P3 of the group G are brazed to a portion of the first header tank 3 located above the second header tank 4, and the heat exchange tubes 2A which form the fourth heat exchange path P4 provided below the group G are brazed to a portion of the first header tank 3 located below the second header tank 4. Therefore, the heat exchange tubes 2A, which form the third and fourth heat exchange paths P3, P4, are the first heat exchange tubes, and the heat exchange tubes 2B, which form the first and second heat exchange paths P1, P2, are the second heat exchange tubes.

The interior of the third header tank 5 is divided into an intermediate header section 73, an upper header section 74, and a lower header section 75 by aluminum partition plates 71 and 72, which are provided at a height between the first heat exchange path P1 and the second heat exchange path P2 and a height between the first heat exchange path P1 and the fourth heat exchange path P4, respectively. A refrigerant inlet 76 is formed at a lower end portion of the intermediate header section 73 of the third header tank 5, and a refrigerant outlet 77 is formed at the lower header section 75 of the third header tank 5. Left end portions of the second heat exchange tubes 2B of the first heat exchange path P1 are connected to the second header tank 4, and right end portions thereof are connected to the intermediate header section 73 of the third header tank 5. Left end portions of the second heat exchange tubes 2B of the second heat exchange path P2 are connected to the second header tank 4, and right end portions thereof are connected to the upper header section 74 of the third header tank 5. Left end portions of the first heat exchange tubes 2A of the third heat exchange path P3 are connected to the first header tank 3, and right end portions thereof are connected to the upper header section 74 of the third header tank 5. Left end portions of the first heat exchange tubes 2A of the fourth heat exchange path P4 are connected to the first header tank 3, and right end portions thereof are connected to the lower header section 75 of the third header tank 5. As a result, in the group G, refrigerant flows from the first heat exchange path P1 at the lower end toward the third heat exchange path P3 at the upper end, as described above. Notably, a refrigerant inlet member (not shown) which communicates with the refrigerant inlet 76 and a refrigerant outlet member (not shown) which communicates with the refrigerant outlet 77 are joined to the third header tank 5.

The second header tank 4, a portion of the first header tank 3 to which the first heat exchange tubes 2A of the third heat exchange path P3 are connected, the intermediate and upper header sections 73 and 74 of the third header tank 5, and the first to third heat exchange paths P1-P3 form a condensation section 70A, which condenses refrigerant. A portion of the first header tank 3 to which the first heat exchange tubes 2A of the fourth heat exchange path P4 are connected, the lower header section 75 of the third header tank 5, and the fourth heat exchange path P4 form a super-cooling section 70B, which super-cools refrigerant. The first to third heat exchange paths P1-P3, which are all the heat exchange paths of the group G, each serve as a refrigerant condensation path for condensing refrigerant, and the fourth heat exchange path P4 located below the group G serves as a refrigerant super-cooling path for super-cooling refrigerant.

Although not illustrated, in the condenser 70 shown in FIG. 11, an intermediate member 18 formed of aluminum is disposed between the lower end first heat exchange tube 2A of the third heat exchange path P3 and the upper end second heat exchange tube 2B of the second heat exchange path P2 and between the upper end first heat exchange tube 2A of the fourth heat exchange path P4 and the lower end second heat exchange tube 2B of the first heat exchange path P1 such that the intermediate member 18 is separated from these heat exchange tubes 2A, 2B and becomes substantially parallel to the heat exchange tubes 2A, 2B. A first corrugate fin 6A is disposed between the lower end first heat exchange tube 2A of the third heat exchange path P3 and the corresponding intermediate member 18, and is brazed to the first heat exchange tube 2A and the intermediate member 18. A first corrugate fin 6A is also disposed between the upper end first heat exchange tube 2A of the fourth heat exchange path P4 and the corresponding intermediate member 18, and is brazed to the first heat exchange tube 2A and the intermediate member 18. A second corrugate fin 6B is disposed between the upper end second heat exchange tube 2B of the second heat exchange path P2 and the corresponding intermediate member 18, and is brazed to the second heat exchange tube 2B and the intermediate member 18. A second corrugate fin 6B is also disposed between the lower end second heat exchange tube 2B of the first heat exchange path P1 and the corresponding intermediate member 18, and is brazed to the second heat exchange tube 2B and the intermediate member 18.

The remaining structure is similar to that of the condenser shown in FIGS. 1 to 3.

In the condenser 70 shown in FIG. 11, gas phase refrigerant of high temperature and high pressure compressed by the compressor flows into the intermediate header section 73 of the third header tank 5 via the refrigerant inlet member and the refrigerant inlet 76. The gas phase refrigerant is condensed while flowing leftward within the second heat exchange tubes 2B of the first heat exchange path P1, and then flows into the second header tank 4. The refrigerant having flowed into the second header tank 4 is condensed while flowing rightward within the second heat exchange tubes 2B of the second heat exchange path P2, and then flows into the upper header section 74 of the third header tank 5. The refrigerant having flowed into the upper header section 74 of the third header tank 5 is condensed while flowing leftward within the first heat exchange tubes 2A of the third heat exchange path P3, and then flows into the first header tank 3.

The refrigerant having flowed into the first header tank 3 is gas-liquid mixed phase refrigerant. A portion of the gas-liquid mixed phase refrigerant; i.e., liquid-predominant mixed phase refrigerant, remains in a lower region within the first header tank 3 because of gravitational force, and enters the first heat exchange tubes 2A of the fourth heat exchange path P4. The liquid-predominant mixed phase refrigerant having entered the first heat exchange tubes 2A of the fourth heat exchange path P4 is super-cooled while flowing rightward within the first heat exchange tubes 2A. After that, the super-cooled refrigerant enters the lower header section 75 of the third header tank 5, and flows out via the refrigerant outlet 77 and the refrigerant outlet member. The refrigerant is then fed to the evaporator via the expansion valve.

Meanwhile, the gas phase component of the gas-liquid mixed phase refrigerant having flowed into the first header tank 3 remains in an upper region within the first header tank 3.

Figure 12:
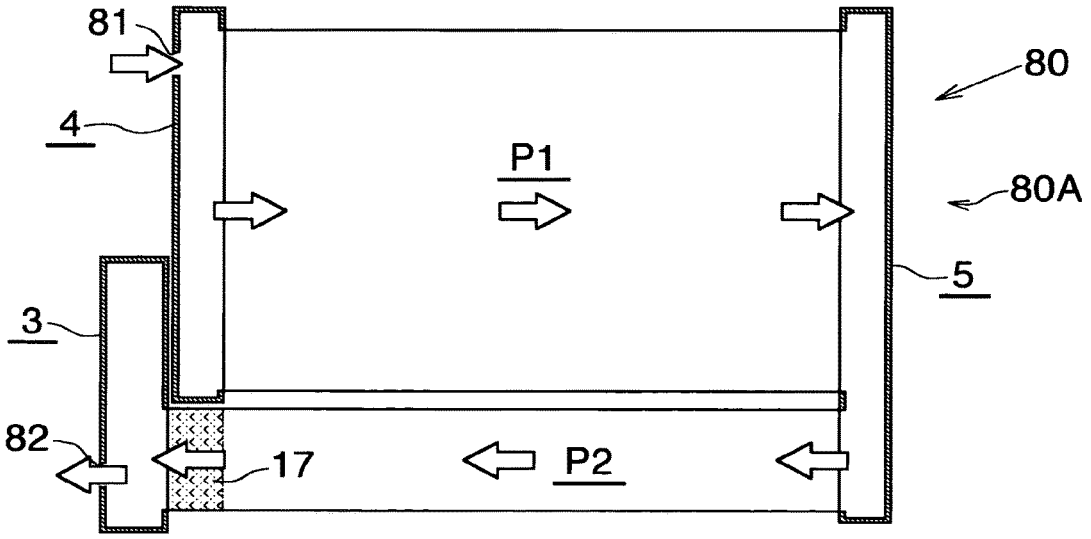
FIG. 12 is a front view schematically showing an eighth embodiment of the condenser according to the present invention.

In the case of a condenser 80 shown in FIG. 12, two heat exchange paths P1, P2 each formed by a plurality of heat exchange tubes 2A, 2B successively arranged in the vertical direction are juxtaposed in the vertical direction. The two heat exchange paths will be referred to as the first and second heat exchange paths P1, P2 from the upper side. The flow direction of refrigerant is the same among all the heat exchange tubes 2A, 2B which form the respective heat exchange paths P1, P2. The flow direction of refrigerant in the heat exchange tubes 2A, 2B which form a certain heat exchange path is opposite the flow direction of refrigerant in the heat exchange tubes 2A, 2B which form another heat exchange path adjacent to the certain heat exchange path.

Left and right end portions of the heat exchange tubes 2B, which form the first heat exchange path P1, are connected to the second header tank 4 and the third header tank 5, respectively, by means of brazing. Left and right end portions of the heat exchange tubes 2A, which form the second heat exchange path P2, are connected to the first header tank 3 and the third header tank 5, respectively, by means of brazing. Notably, the upper end of the first header tank 3; that is, one end portion of the first header tank 3 opposite the side where the second heat exchange path P2 formed by the heat exchange tubes 2A connected to the first header tank 3 is located, is located at an intermediate portion of the second header tank 4 with respect to the longitudinal direction thereof. Therefore, the heat exchange tubes 2A, which form the second heat exchange path P2, are the first heat exchange tubes, and the heat exchange tubes 2B, which form the first heat exchange path P1, are the second heat exchange tubes.

The first through third header tank 3-5, and the first and second heat exchange paths P1, P2 form a condensation section 80A, which condenses refrigerant. The first and second heat exchange paths P1, P2 (i.e., all the heat exchange paths) each serve as a refrigerant condensation path for condensing refrigerant.

A refrigerant inlet 81 is formed at an upper end portion of the second header tank 4, which forms the condensation section 80A, and a refrigerant outlet 82 is formed at a lower end portion of the first header tank 3. A refrigerant inlet member (not shown) which communicates with the refrigerant inlet 81 is joined to the second header tank 4, and a refrigerant outlet member (not shown) which communicates with the refrigerant outlet 82 are joined to the first header tank 3.

Although not illustrated, in the condenser 80 shown in FIG. 12, an intermediate member 18 formed of aluminum is disposed between the upper end first heat exchange tube 2A of the second heat exchange path P2 and the lower end second heat exchange tube 2B of the first heat exchange path P1 such that the intermediate member 18 is separated from these heat exchange tubes 2A, 2B and becomes substantially parallel to the heat exchange tubes 2A, 2B. A first corrugate fin 6A is disposed between the upper end first heat exchange tube 2A of the second heat exchange path P2 and the intermediate member 18, and is brazed to the first heat exchange tube 2A and the intermediate member 18. A second corrugate fin 6B is disposed between the lower end second heat exchange tube 2B of the first heat exchange path P1 and the intermediate member 18, and is brazed to the second heat exchange tube 2B and the intermediate member 18.

The remaining structure is similar to that of the condenser shown in FIGS. 1 to 3.

In the condenser 80 shown in FIG. 12, gas phase refrigerant of high temperature and high pressure compressed by the compressor flows into the second header tank 4 via the refrigerant inlet member and the refrigerant inlet 81. The gas phase refrigerant is condensed while flowing rightward within the second heat exchange tubes 2B of the first heat exchange path P1, and then flows into the third header tank 5. The refrigerant having flowed into the third header tank 5 is condensed while flowing leftward within the first heat exchange tubes 2A of the second heat exchange path P2, and then flows into the first header tank 3.

The refrigerant having flowed into the first header tank 3 is gas-liquid mixed phase refrigerant. A portion of the gas-liquid mixed phase refrigerant; i.e., liquid-predominant mixed phase refrigerant, remains in a lower region within the first header tank 3 because of gravitational force, and flows out via the refrigerant outlet 82 and the refrigerant outlet member. The refrigerant is then fed to the evaporator via the expansion valve.

Meanwhile, the gas phase component of the gas-liquid mixed phase refrigerant having flowed into the first header tank 3 remains in an upper region within the first header tank 3.

Figure 13:
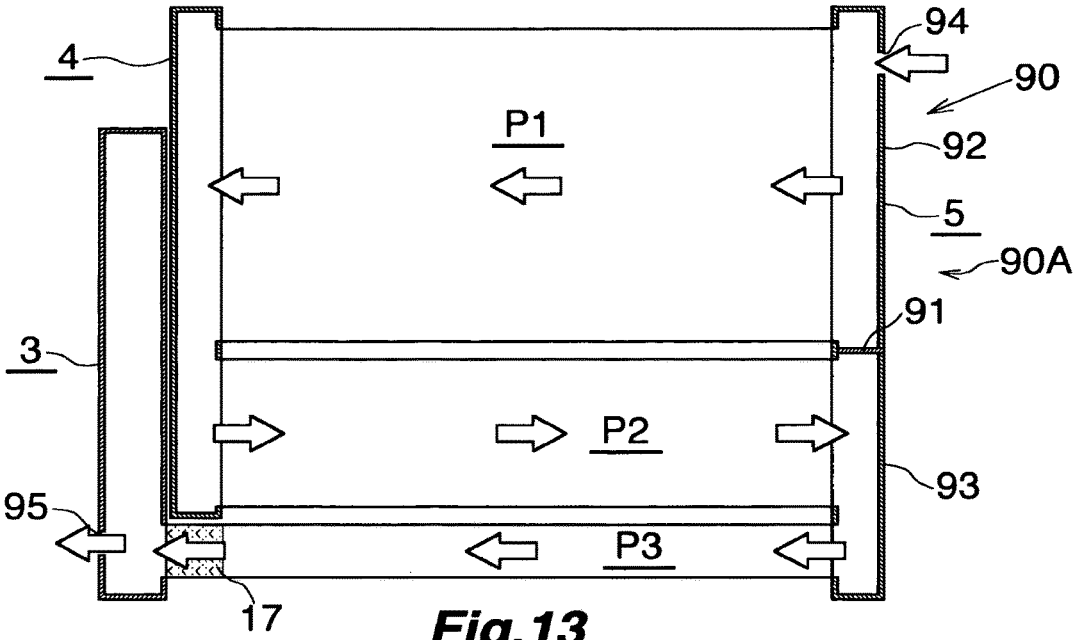
FIG. 13 is a front view schematically showing a ninth embodiment of the condenser according to the present invention.

In the case of a condenser 90 shown in FIG. 13, three heat exchange paths P1, P2, P3 each formed by a plurality of heat exchange tubes 2A, 2B successively arranged in the vertical direction are juxtaposed in the vertical direction. The three heat exchange paths will be referred to as the first to third heat exchange paths P1, P2, P3 from the upper side. The flow direction of refrigerant is the same among all the heat exchange tubes 2A, 2B which form the respective heat exchange paths P1, P2, P3. The flow direction of refrigerant in the heat exchange tubes 2A, 2B which form a certain heat exchange path is opposite the flow direction of refrigerant in the heat exchange tubes 2A, 2B which form another heat exchange path adjacent to the certain heat exchange path.

Left and right end portions of the heat exchange tubes 2B, which form the first and second heat exchange paths P1, P2, are connected to the second header tank 4 and the third header tank 5, respectively, by means of brazing. Left and right end portions of the heat exchange tubes 2A, which form the third heat exchange path P3, are connected to the first header tank 3 and the third header tank 5, respectively, by means of brazing. Notably, the upper end of the first header tank 3; that is, one end portion of the first header tank 3 opposite the side where the second heat exchange path P2 formed by the heat exchange tubes 2A connected to the first header tank 3 is located, is located at an intermediate portion of the second header tank 4 with respect to the longitudinal direction thereof. Therefore, the heat exchange tubes 2A, which form the third heat exchange path P3, are the first heat exchange tubes, and the heat exchange tubes 2B, which form the first and second heat exchange paths P1, P2, are the second heat exchange tubes.

The interior of the third header tank 5 is divided into an upper header section 92 and a lower header section 93 by an aluminum partition plate 91 provided at a height between the first heat exchange path P1 and the second heat exchange path P2. A refrigerant inlet 94 is formed at an upper end portion of the upper header section 92 of the third header tank 5, and a refrigerant outlet 95 is formed at a lower end portion of the first header tank 3. Left end portions of the second heat exchange tubes 2B of the first heat exchange path P1 are connected to the second header tank 4, and right end portions thereof are connected to the upper header section 92 of the third header tank 5. Left end portions of the second heat exchange tubes 2B of the second heat exchange path P2 are connected to the second header tank 4, and right end portions thereof are connected to the lower header section 93 of the third header tank 5. Left end portions of the first heat exchange tubes 2A of the third heat exchange path P3 are connected to the first header tank 3, and right end portions thereof are connected to the lower header section 93 of the third header tank 5. Notably, a refrigerant inlet member (not shown) which communicates with the refrigerant inlet 94 is joined to the upper header section 92 of the third header tank 5, and a refrigerant outlet member (not shown) which communicates with the refrigerant outlet 95 is joined to the first header tank 3.

The first to third header tank 3 to 5 and the first to third heat exchange paths P1-P3 form a condensation section 90A, which condenses refrigerant. The first to third heat exchange paths P1-P3; i.e., all the heat exchange paths, each serve as a refrigerant condensation path for condensing refrigerant.

Although not illustrated, in the condenser 90 shown in FIG. 13, an intermediate member 18 formed of aluminum is disposed between the upper end first heat exchange tube 2A of the third heat exchange path P3 and the lower end second heat exchange tube 2B of the second heat exchange path P2 such that the intermediate member 18 is separated from these heat exchange tubes 2A, 2B and becomes substantially parallel to the heat exchange tubes 2A, 2B. A first corrugate fin 6A is disposed between the upper end first heat exchange tube 2A of the third heat exchange path P3 and the intermediate member 18, and is brazed to the first heat exchange tube 2A and the intermediate member 18. A second corrugate fin 6B is disposed between the lower end second heat exchange tube 2B of the second heat exchange path P2 and the intermediate member 18, and is brazed to the second heat exchange tube 2B and the intermediate member 18.

The remaining structure is similar to that of the condenser shown in FIGS. 1 to 3.

In the condenser 90 shown in FIG. 13, gas phase refrigerant of high temperature and high pressure compressed by the compressor flows into the upper header section 92 of the third header tank 5 via the refrigerant inlet member and the refrigerant inlet 94. The gas phase refrigerant is condensed while flowing leftward within the second heat exchange tubes 2B of the first heat exchange path P1, and then flows into the second header tank 4. The refrigerant having flowed into the second header tank 4 is condensed while flowing rightward within the second heat exchange tubes 2B of the second heat exchange path P2, and then flows into the lower header section 93 of the third header tank 5. The refrigerant having flowed into the lower header section 93 of the third header tank 5 is condensed while flowing leftward within the first heat exchange tubes 2A of the third heat exchange path P3, and then flows into the first header tank 3.

The refrigerant having flowed into the first header tank 3 is gas-liquid mixed phase refrigerant. A portion of the gas-liquid mixed phase refrigerant; i.e., liquid-predominant mixed phase refrigerant, remains in a lower region within the first header tank 3 because of gravitational force, and flows out via the refrigerant outlet 95 and the refrigerant outlet member. The refrigerant is then fed to the evaporator via the expansion valve.

Meanwhile, the gas phase component of the gas-liquid mixed phase refrigerant having flowed into the first header tank 3 remains in an upper region within the first header tank 3.

Figure 14:
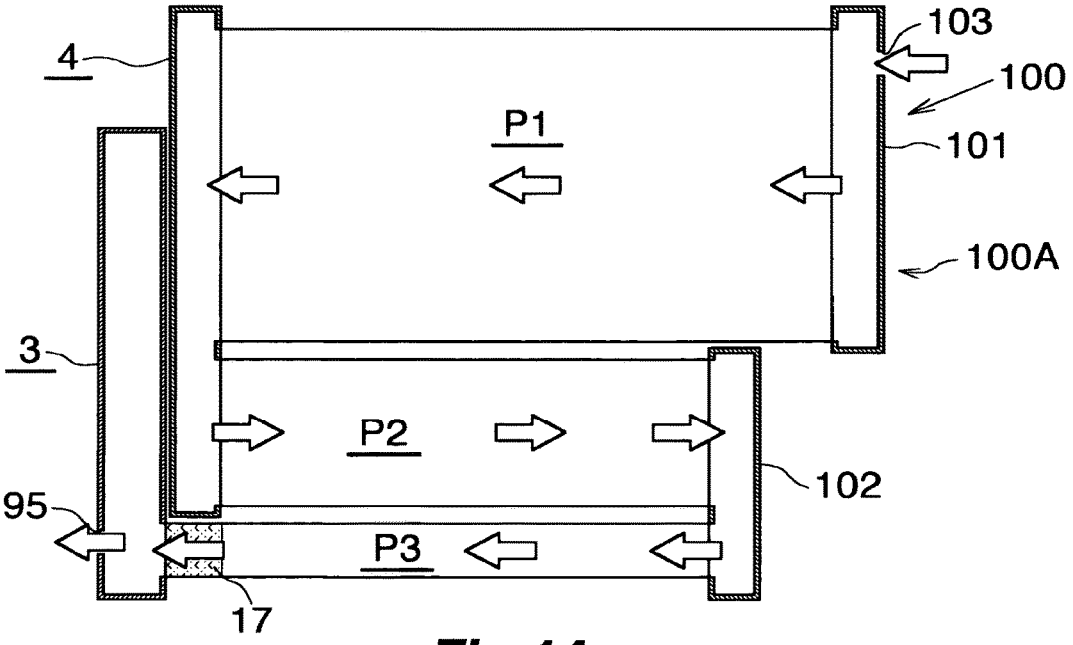
FIG. 14 is a front view schematically showing a tenth embodiment of the condenser according to the present invention.

In the case of a condenser 100 shown in FIG. 14, a third header tank 101 and a fourth header tank 102 are provided individually on the right end side. Right end portions of the second heat exchange tubes 2B of the first heat exchange path P1 are connected to the third header tank 101 by means of brazing. The fourth header tank 102 is disposed below the third header tank 101. Right end portions of the second heat exchange tubes 2B of the second heat exchange path P2 and right end portions of the first heat exchange tubes 2A of the third heat exchange path P3 are connected to the fourth header tank 102 by means of brazing.

The first to fourth header tank 3, 4, 101, 102, and the first to third heat exchange paths P1-P3 form a condensation section 100A, which condenses refrigerant. The first to third heat exchange paths P1-P3; i.e., all the heat exchange paths, each serve as a refrigerant condensation path for condensing refrigerant. A refrigerant inlet 103 is formed at an upper end portion of the third header tank 101.

The remaining structure is similar to that of the condenser shown in FIG. 13.

In the condenser 100 shown in FIG. 14, gas phase refrigerant of high temperature and high pressure compressed by the compressor flows into the third header tank 101 via the refrigerant inlet member and the refrigerant inlet 103. The gas phase refrigerant is condensed while flowing leftward within the second heat exchange tubes 2B of the first heat exchange path P1, and then flows into the second header tank 4. The refrigerant having flowed into the second header tank 4 is condensed while flowing rightward within the second heat exchange tubes 2B of the second heat exchange path P2, and then flows into the fourth header tank 102. The refrigerant having flowed into the fourth header tank 102 is condensed while flowing leftward within the first heat exchange tubes 2A of the third heat exchange path P3, and then flows into the first header tank 3.

The refrigerant having flowed into the first header tank 3 is gas-liquid mixed phase refrigerant. A portion of the gas-liquid mixed phase refrigerant; i.e., liquid-predominant mixed phase refrigerant, remains in a lower region within the first header tank 3 because of gravitational force, and flows out via the refrigerant outlet 95 and the refrigerant outlet member. The refrigerant is then fed to the evaporator via the expansion valve.

Meanwhile, the gas phase component of the gas-liquid mixed phase refrigerant having flowed into the first header tank 3 remains in an upper region within the first header tank 3.

Although not illustrated, in the condensers 20, 30, 35, 50, 60, 70, 110, 90, 100 shown in FIGS. 4 to 6 and 9 to 14, all the heat exchange tubes 2A 2B are straight, and left end portions of the first heat exchange tubes 2A connected to the first header tank 3 extend leftward beyond left end portions of the second heat exchange tubes 2B connected to the second header tank 4. Thus, the first heat exchange tubes 2A have, on the left side thereof, projecting portions 2*a*, which project leftward beyond the left end portions of the second heat exchange tubes 2B. Furthermore, left end portions of the first corrugate fins 6A extend leftward beyond left end portions of the second corrugate fins 6B. Thus, the first corrugate fins 6A have, on the left side thereof, projecting portions 6*a*, which project leftward beyond the left end portions of the second corrugate fins 6B and are disposed between the projecting portions 2*a* of the adjacent first heat exchange tubes 2A. Thus, a heat exchange section 17 is formed by the projecting portions 2*a* of all the first heat exchange tubes 2A and the projecting portions 6*a* of all the first corrugate fins 6A. In FIGS. 4 to 6 and 9 to 14, the heat exchange section 17 is indicated by tinting.

Figure 15:
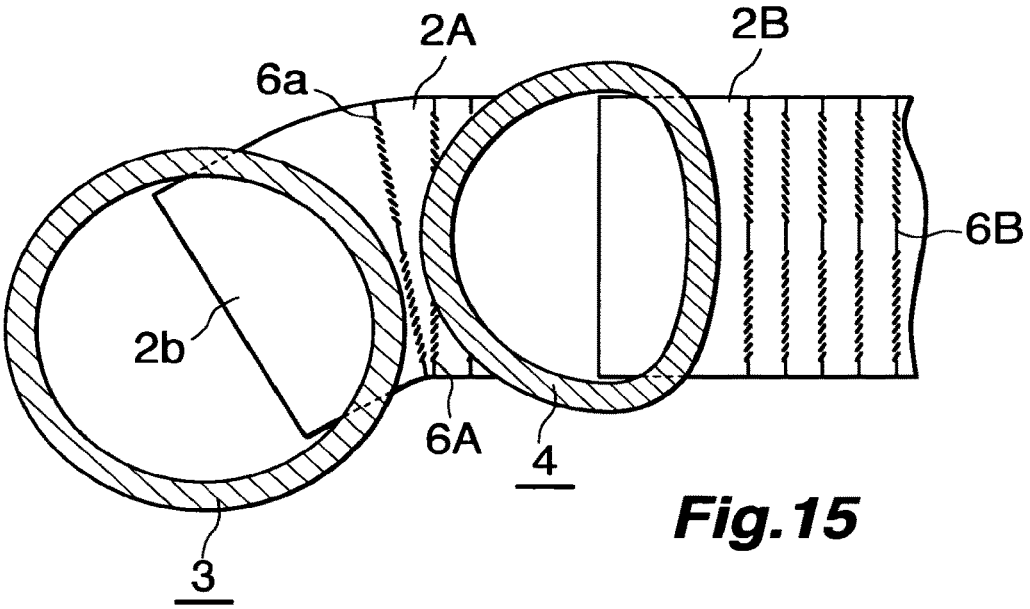
FIG. 15 is a sectional view corresponding to FIG. 2 and showing a modification of the condenser of the present invention concerning the position of the first header tank and the first heat exchange tubes.

FIG. 15 shows a modification regarding the position at which the first header tank of the condenser is provided and the first heat exchange tubes.

In FIG. 15, the first header tank 3 is disposed leftward of and diagonally rearward of the second header tank 4. The first header tank 3 and the second header tank 4 do not have portions overlapping each other as viewed in a horizontal cross section or as viewed from above. Left end portions of the first heat exchange tubes 2A connected to the first header tank 3 are bent diagonally rearward. A bent portion 2*b* of each bent first heat exchange tube 2A is located in the same plane as the remaining unbent portion of the first heat exchange tube 2A. The projecting portion 6*a* at the left end of each first corrugate fin 6A is present between the bent portions 2*b* of adjacent first heat exchange tubes 2A.

Figure 16:
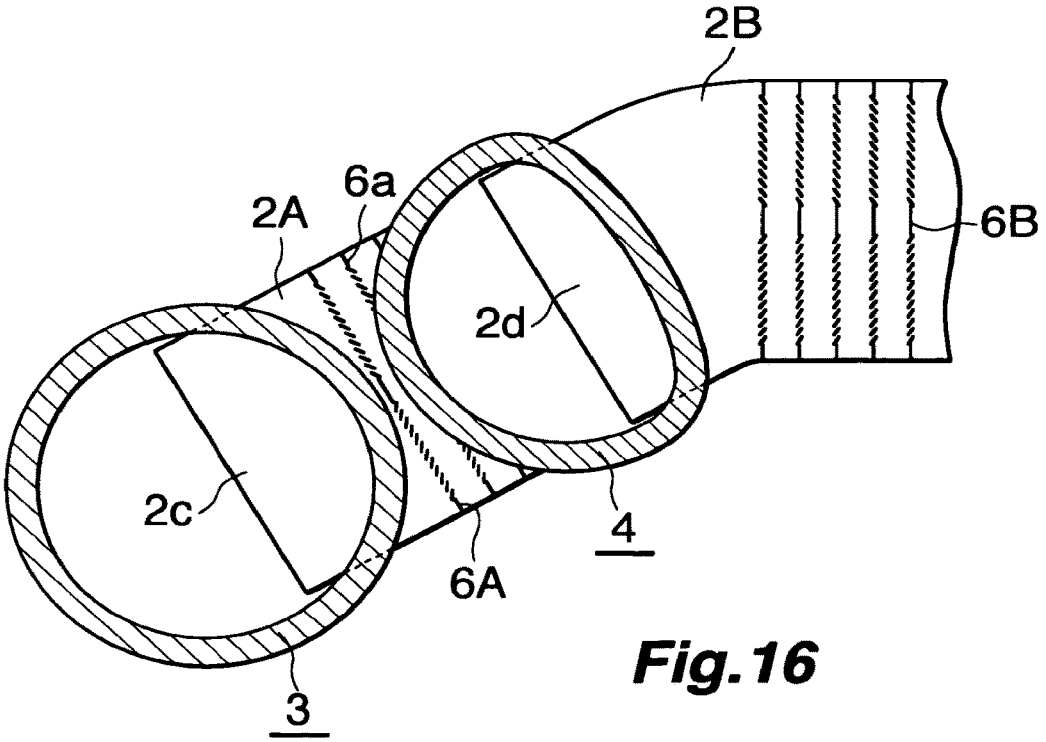
FIG. 16 is a sectional view corresponding to FIG. 2 and showing a modification of the condenser of the present invention concerning the positions of the first and second header tanks and the first and second heat exchange tubes.

FIG. 16 shows a modification regarding the positions at which the first and second header tanks of the condenser are provided and the first and second heat exchange tubes.

In FIG. 16, the second header tank 4 is disposed rearward of the third header tank 5, and the first header tank 3 is disposed leftward of and diagonally rearward of the second header tank 4. The first header tank 3 and the second header tank 4 do not have portions overlapping each other as viewed in a horizontal cross section or as viewed from above. Left end portions of the first heat exchange tubes 2A connected to the first header tank 3 and left end portions of the second heat exchange tubes 2B connected to the second header tank 4 are respectively bent diagonally rearward at the same angle. A bent portion 2*c* of each bent first heat exchange tube 2A is located in the same plane as the remaining unbent portion of the first heat exchange tube 2A. Similarly, a bent portion 2*d* of each bent second heat exchange tube 2B is located in the same plane as the remaining unbent portion of the second heat exchange tube 2B. Furthermore, the second header tank 4 is disposed leftward of and diagonally rearward of the center line (with respect to the width direction) of the unbent portion of each second heat exchange tube 2B connected to the second header tank 4, and the first header tank 3 is disposed leftward of and diagonally rearward of the second header tank 4. The projecting portion 6*a* at the left end of each first corrugate fin 6A is present between the bent portions 2*c* of adjacent first heat exchange tubes 2A.

What is claimed is:

1. A condenser comprising heat exchange tubes disposed in parallel such that the heat exchange tubes are spaced apart from one another in a vertical direction and extend in a left-right direction; and header tanks which extend in the vertical direction and to which left and right end portions of the heat exchange tubes are connected, wherein first and second header tanks are provided at the left or right end of the condenser;

the first header tank is disposed on an outer side of the second header tank with respect to the left-right direction, the first header tank has an upper end located above a lower end of the second header tank in the vertical direction when the first and second header tanks are oriented to longitudinally extend in directions parallel to the vertical direction, and the first header tank has a function of separating gas and liquid from each other and storing the liquid;

first heat exchange tubes connected to the first header tank have projecting portions at their ends located on a side toward the first header tank, the projecting portions extending outward, with respect to the left-right direction, of second-header-tank-side end portions of second heat exchange tubes connected to the second header tank, the first heat exchange tubes being longer than the second heat exchange tubes by a length of the projecting portions in the left-right direction and being positioned downstream of the second heat exchange tubes with respect to a flow of refrigerant, fins being disposed between the projecting portions of adjacent first heat exchange tubes; and the projecting portions of all the first heat exchange tubes and the fins between the projecting portions of the adjacent first heat exchange tubes form a heat exchange section.

2. A condenser according to claim 1, further comprising:

at least one of a desiccant, a gas-liquid separation member, and a filter which are disposed within the first header tank.

3. A condenser according to claim 1, wherein the first header tank and the second header tank are positionally shifted from each other.

4. A condenser according to claim 1, wherein the refrigerant is to flow into the second header tank from an outside of the condenser.

5. A condenser according to claim 1, wherein the upper end of the first header tank is located above a lower end of the plurality of second heat exchange tubes.

6. A condenser comprising:

a second header tank which is provided on one side of the condenser with respect to a left-right direction of the condenser to extend in a first direction perpendicular to the left-right direction;

a first header tank provided on the one side of the condenser to extend in the first direction and at an outer side of the second header tank with respect to the left-right direction and having a gas-liquid separation function, an upper end of the first header tank being located above a lower end of the second header tank in a vertical direction when the first and second header tanks are oriented to longitudinally extend in directions parallel to the vertical direction;

a third header tank provided on another side of the condenser opposite to the one side with respect to the left-right direction;

a plurality of second heat exchange tubes extending in the left-right direction between the second header tank and the third header tank to connect the second header tank and the third header tank;

a plurality of first heat exchange tubes provided to extend in the left-right direction between the first header tank and the third header tank to connect the first header tank and the third header tank, the plurality of first heat exchange tubes being directly connected to the first header tank, the plurality of first heat exchange tubes being longer than the plurality of second heat exchange tubes by a length of projecting portions in the left-right direction and being positioned downstream of the plurality of second heat exchange tubes with respect to a flow of refrigerant; and fins provided between the plurality of first heat exchange tubes at the projecting portions.

7. A condenser according to claim 6, further comprising:

at least one of a desiccant, a gas-liquid separation member, and a filter which are disposed within the first header tank.

8. A condenser according to claim 6, wherein the first header tank and the second header tank are positionally shifted from each other.

9. A condenser according to claim 6, wherein the refrigerant is to flow into the second header tank from an outside of the condenser.

10. A condenser according to claim 6, wherein the upper end of the first header tank is located above a lower end of the plurality of second heat exchange tubes.

11. A condenser comprising:

a second header tank which is provided on one side of the condenser;

a first header tank provided on the one side of the condenser and having a gas-liquid separation function, an upper end of the first header tank being located above a lower end of the second header tank in a vertical direction when the first and second header tanks are oriented to longitudinally extend in directions parallel to the vertical direction;

a third header tank provided on another side of the condenser opposite to the one side;

a plurality of second heat exchange tubes extending in an extending direction between the second header tank and the third header tank to connect the second header tank and the third header tank;

a plurality of first heat exchange tubes provided to extend in the extending direction between the first header tank and the third header tank to connect the first header tank and the third header tank, the plurality of first heat exchange tubes being directly connected to the first header tank, the plurality of first heat exchange tubes being longer than the plurality of second heat exchange tubes by a length of projecting portions in the extending direction and being positioned downstream of the plurality of second heat exchange tubes with respect to a flow of refrigerant; and fins provided between the plurality of first heat exchange tubes at the projecting portions.

12. A condenser according to claim 11, further comprising:

at least one of a desiccant, a gas-liquid separation member, and a filter which are disposed within the first header tank.

13. A condenser according to claim 11, wherein the first header tank and the second header tank are positionally shifted from each other.

14. A condenser according to claim 11, wherein the refrigerant is to flow into the second header tank from an outside of the condenser.

15. A condenser according to claim 11, wherein the upper end of the first header tank is located above a lower end of the plurality of second heat exchange tubes.

* * * * *